US008733120B2

(12) United States Patent
Morimoto et al.

(10) Patent No.: US 8,733,120 B2
(45) Date of Patent: May 27, 2014

(54) AIR-CONDITIONING APPARATUS

(75) Inventors: Hiroyuki Morimoto, Chiyoda-ku (JP); Koji Yamashita, Chiyoda-ku (JP); Yuji Motomura, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 104 days.

(21) Appl. No.: 13/511,695

(22) PCT Filed: Nov. 30, 2009

(86) PCT No.: PCT/JP2009/006463

§ 371 (c)(1),
(2), (4) Date: May 24, 2012

(87) PCT Pub. No.: WO2011/064827

PCT Pub. Date: Jun. 3, 2011

(65) Prior Publication Data

US 2012/0291472 A1 Nov. 22, 2012

(51) Int. Cl.
*F25B 13/00* (2006.01)

(52) U.S. Cl.
USPC ..... 62/324.6; 62/509

(58) Field of Classification Search
USPC ..... 62/324.6, 178, 157, 498, 509, 238.1, 62/129, 159, 238.7
See application file for complete search history.

(56) References Cited

U.S. PATENT DOCUMENTS 3,188,829 A * 6/1965 Siewert et al. ..... 62/160
3,365,902 A * 1/1968 Nussbaum ..... 62/155
3,918,268 A * 11/1975 Nussbaum ..... 62/150
RE29,966 E * 4/1979 Nussbaum ..... 62/150
4,553,401 A * 11/1985 Fisher ..... 62/160
5,109,677 A * 5/1992 Phillippe ..... 62/160
5,802,864 A * 9/1998 Yarbrough et al. ..... 62/238.6
5,901,563 A * 5/1999 Yarbrough et al. ..... 62/238.7
6,253,564 B1 * 7/2001 Yarbrough et al. ..... 62/238.7

FOREIGN PATENT DOCUMENTS

AU 42562/89 B 9/1991
JP 1-247966 A 10/1989
JP 2-118372 A 5/1990

(Continued)

OTHER PUBLICATIONS

International Search Report (PCT/ISA/210) issued on Feb. 23, 2010, by the Japanese Patent Office as the International Searching Authority for International Application No. PCT/JP2009/006463.

(Continued)

*Primary Examiner* — Mohammad M Ali
(74) *Attorney, Agent, or Firm* — Buchanan Ingersoll & Rooney PC

(57) ABSTRACT

An air-conditioning apparatus that that is capable of saving energy is provided. An air-conditioning apparatus includes a refrigerant indoor unit that air-conditions a conditioned space by using a heat source side refrigerant supplied from an outdoor unit, and a heat medium indoor unit that air-conditions a conditioned space by using a heat medium different from the heat source side refrigerant. The air-conditioning apparatus includes a first heat medium relay unit that is supplied with the heat source side refrigerant from the outdoor unit, a third heat medium relay unit interposed between the first heat medium relay unit and the refrigerant indoor unit, and a third heat medium relay unit interposed between the first heat medium relay unit and the heat medium indoor unit.

7 Claims, 13 Drawing Sheets

(56) References Cited

FOREIGN PATENT DOCUMENTS

| | | | |
|---|---|---|---|
| JP | 5-172431 | A | 7/1993 |
| JP | 2003-130482 | A | 5/2003 |
| JP | 2003-343936 | | 12/2003 |
| WO | WO 2009/133643 | A1 | 11/2009 |

OTHER PUBLICATIONS

Jan. 10, 2014 Chinese Office Action issued in Chinese Patent Application No. 200980162651.8.

* cited by examiner

AIR-CONDITIONING APPARATUS

TECHNICAL FIELD

The present invention relates to air-conditioning apparatuses applied to, for example, multi-air-conditioning apparatuses used in buildings, and particularly, to an air-conditioning apparatus that can perform, in a mixed fashion, cooling/heating operation using a heat medium and cooling/heating operation using a refrigerant different from the heat medium so as to achieve a higher degree of freedom in terms of installation.

BACKGROUND ART

Hitherto, an air-conditioning apparatus that conveys cooling energy or heating energy to a conditioned space, such as an indoor room, by causing a refrigerant to circulate between an outdoor unit serving as a heat source unit disposed outdoors and an indoor unit disposed indoors so as to perform cooling operation or heating operation is applied to a multi-air-conditioning apparatus for a building (for example, see Patent Literature 1). As a refrigerant used in such an air-conditioning apparatus, an HFC (hydrofluorocarbon) based refrigerant is commonly used. Moreover, in recent years, natural refrigerant, such as carbon dioxide ($CO_2$), has also been used.

There are also other air-conditioning apparatuses with different configurations, one representative example of which being a chiller system. Such an air-conditioning apparatus performs cooling operation or heating operation by generating cooling energy or heating energy in a heat source unit disposed outdoors, transferring the cooling energy or the heating energy to a heat medium, such as water or antifreeze, at a heat exchanger disposed in the outdoor unit, and conveying the heat medium to a fan coil unit or a panel heater serving as an indoor unit disposed in the conditioned space (for example, see Patent Literature 2). Furthermore, a so-called waste heat recovery chiller in which the heat source unit is connected to four water pipings for supplying cooling energy or heating energy is also known.

CITATION LIST

Patent Literature

Patent Literature 1: Japanese Unexamined Patent Application Publication No. 2-118372 (page 3, FIG. 1)

Patent Literature 2: Japanese Unexamined Patent Application Publication No. 2003-343936 (page 5, FIG. 1)

SUMMARY OF INVENTION

Technical Problem

In the air-conditioning apparatus of the related art, since a high-pressure refrigerant is conveyed to the indoor unit, the amount of refrigerant loaded therein becomes extremely large. If the refrigerant were to leak from the refrigerant circuit, the refrigerant would adversely affect the global environment, such as inducing global warming. In particular, R410A has a high global warming potential of 1970, and it is extremely important to reduce the amount of refrigerant loaded in view of global environmental protection if such a refrigerant is to be used. Furthermore, if the refrigerant leaks into a living space, the refrigerant can have an adverse effect on the human body due to the chemical properties of the refrigerant. For this reason, measures, such as excessive ventilation or installment of a leak sensor, need to be taken, leading to an increase in cost and power consumption.

Such problems can be solved with the chiller system discussed in Patent Literature 2. However, since heat exchange between the refrigerant and water is performed in the outdoor unit, and the water is then conveyed to the indoor unit, the power required for conveying the water is extremely large, resulting in an increase in energy consumption. In addition, if both the cooling energy and the heating energy were to be supplied using water or the like, a pump, a three-way valve, or an equivalent instrument, for example, would be need to be prepared on-site, and the number of pipings would be need to be increased in order to perform the cooling operation and the heating operation at the same time, resulting in an increase in labor, time and cost required for the installation and test-drive processes.

In the case of a chiller system, if by any chance water leakage from the indoor unit occurs in a room where a personal computer and a server or the like are disposed (that is, a server room) or in a power room that accommodates a power source, the personal computer and the server may possibly malfunction, or a short circuit may possibly be caused in the power room. In particular, since cooling of server-related devices maintains the information infrastructure, a server shutdown caused by failure leads to a significant loss. For this reason, air-conditioning apparatuses from now onward need to be designed with a view to decrease the amount of refrigerant used as well as adverse effects on the human body if the refrigerant may leak. In addition, air-conditioning apparatuses need to be designed so as to be applicable in server rooms and power rooms described above, where water, as a heat medium, cannot be used as an alternative for the refrigerant.

The present invention has been made to solve the above-described problems, and an object thereof is to provide an air-conditioning apparatus that achieves a higher degree of freedom in terms of installation, while also saving energy as well as increasing safety.

Solution to Problem

An air-conditioning apparatus according to the invention includes at least one outdoor unit equipped with at least a compressor and a heat source side heat exchanger; at least one refrigerant indoor unit equipped with at least an expansion device and a first use side heat exchanger; at least one heat medium indoor unit equipped with at least a second use side heat exchanger; a first heat medium relay unit interposed between the at least one outdoor unit and the at least one refrigerant indoor unit and between the at least one outdoor unit and the at least one heat medium indoor unit; at least one second heat medium relay unit interposed between the first heat medium relay unit and the at least one heat medium indoor unit, equipped with at least two heat exchangers related to heat medium, transferring heating energy or cooling energy, which is generated in the at least one outdoor unit and is stored in a heat source side refrigerant, to a heat medium different from the heat source side refrigerant via the heat exchangers related to heat medium and supplying the heating energy or the cooling energy to the second use side heat exchanger; and at least one third heat medium relay unit interposed between the first heat medium relay unit and the at least one refrigerant indoor unit, equipped with at least a check valve and an on-off valve for switching refrigerant passages, and supplying the heating energy or the cooling energy generated in the at least one outdoor unit to the first use side heat exchanger.

Advantageous Effects of Invention

With the air-conditioning apparatus according to the invention, since a space where cooling/heating operation is performed by using a refrigerant directly and a space where cooling/heating operation is performed by using a refrigerant indirectly can be separated from each other, increased safety of the system, higher reliability, and a higher degree of freedom in terms of installation can be achieved.

BRIEF DESCRIPTION OF DRAWINGS

FIG. 2 schematically illustrates an installation example of an air-conditioning apparatus according to Embodiment 2 of the invention.

DESCRIPTION OF EMBODIMENTS

Embodiments of the invention will be described below with reference to the drawings.

Embodiment 1

Figure 1:
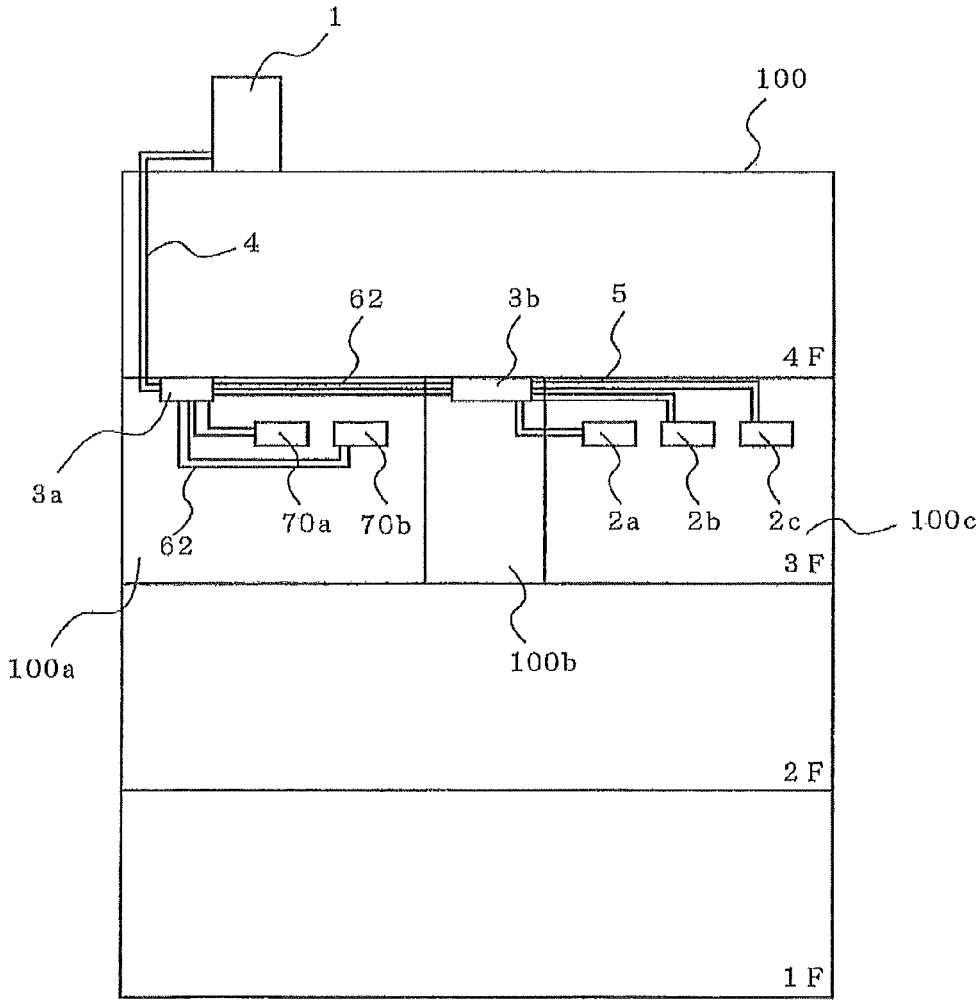
FIG. 1 schematically illustrates an installation example of an air-conditioning apparatus according to Embodiment 1 of the invention.

FIG. 1 schematically illustrates an installation example of an air-conditioning apparatus according to Embodiment 1 of the invention. The installation example of the air-conditioning apparatus will be described with reference to FIG. 1. The air-conditioning apparatus uses refrigeration cycles (a refrigerant circuit a and heat medium circuit b) through which refrigerants (a heat source side refrigerant and a heat medium) circulate, so that each indoor unit can freely select a cooling mode or a heating mode as an operation mode. In the drawings below, including FIG. 1, the dimensional relationship among components may be different from that in actuality.

FIG. 1 shows a state where the air-conditioning apparatus according to Embodiment 1 is installed in a four-story-building 100. The air-conditioning apparatus according to Embodiment 1 includes a single outdoor unit 1 as a heat source unit, multiple heat medium indoor units 2 (indoor units 2*a* to 2*c*), multiple refrigerant indoor units 70 (indoor units 70*a* and 70*b*), a first heat medium relay unit 3*a* interposed between the outdoor unit 1 and the refrigerant indoor units 70, and a second heat medium relay unit 3*b* interposed between the first heat medium relay unit 3*a* and the heat medium indoor units 2.

The outdoor unit 1 is installed on a rooftop of the building 100. The first heat medium relay unit 3*a* and the refrigerant indoor units 70 are installed in a server room 100*a*, which accommodates, for example, a server, on the third floor. The second heat medium relay unit 3*b* is installed in, for example, a shared zone 100*b*, which is normally not accessed by personnel, on the third floor. The heat medium indoor units 2 are installed in a room 100*c*, such as an office, on the third floor. Each heat medium indoor unit 2 accommodates a heat exchanger through which a heat medium (such as water or antifreeze) flows. Each refrigerant indoor unit 70 accommodates a heat medium through which a heat source side refrigerant (a refrigerant different from the heat medium) flows.

Specifically, the air-conditioning apparatus according to Embodiment 1 includes a single outdoor unit 1, multiple heat medium indoor units 2, multiple refrigerant indoor units 70, and two heat medium relay units 3 (the first heat medium relay unit 3*a* and the second heat medium relay unit 3*b*). The outdoor unit 1 and the first heat medium relay unit 3*a* are connected to each other via a refrigerant piping 4 that guides the heat source side refrigerant. The first heat medium relay unit 3*a*, the refrigerant indoor units 70, and the second heat medium relay unit 3*b* are connected to each other via refrigerant pipings 62 that guide the heat source side refrigerant. The second heat medium relay unit 3*b* and the heat medium indoor units 2 are connected to each other via heat medium pipings 5 that guide the heat medium. A circuit configuration of the air-conditioning apparatus according to Embodiment 1 will be described in detail later with reference to FIG. 2 and subsequent figures.

The outdoor unit 1 supplies cooling energy or heating energy to the refrigerant indoor units 70 via the first heat medium relay unit 3*a* and to the heat medium indoor units 2 via the second heat medium relay unit 3*b*. The refrigerant indoor units 70 supply cooling air or heating air to the server room 100*a* that is a conditioned space. The heat medium indoor units 2 supply cooling air or heating air to the room 100*c* that is a conditioned space. The heat medium relay units 3 are provided in housings separate from the outdoor unit 1, the refrigerant indoor units 70, and the heat medium indoor units 2, and convey the cooling energy or the heating energy supplied from the outdoor unit 1 to the refrigerant indoor units 70 and the heat medium indoor units 2.

Although FIG. 1 shows the example in which the second heat medium relay unit 3*b* is installed in the shared zone 100*b*, not limited to the example, the second heat medium relay unit 3*b* may alternatively be installed in a space within the building 100 but separated from the room 100*c*, such as in a space above the ceiling. The refrigerant indoor units 70 and the heat medium indoor units 2 may be of any type, such as a ceiling cassette type, a ceiling concealed type, or a ceiling suspended type, so long as they can blow out heating air or cooling air into the corresponding conditioned spaces directly or via ducts.

Although FIG. 1 shows the example in which the outdoor unit 1 is installed on the rooftop of the building 100, the invention is not limited to this example. For example, the outdoor unit 1 may be disposed in an enclosed space, for example, a machine room with a ventilation opening, may be disposed inside the building 100 as long as waste heat can be exhausted through an exhaust duct to the outside of the building 100, or may be disposed inside the building 100 when the used outdoor unit 1 is of a water-cooled type. Installing the outdoor unit 1 in such places would not particularly lead to problems.

Furthermore, the heat medium relay units 3 may alternatively be installed in the vicinity of the outdoor unit 1. However, since the power required for conveying the heat medium would significantly increase if the distances from the heat medium relay units 3 to the refrigerant indoor units 70 and to the heat medium indoor units 2 were to be increased, it should be noted that the energy saving effect would be reduced. Moreover, the number of the outdoor unit 1, the refrigerant indoor units 70, the heat medium indoor units 2, and the heat medium relay units 3 connected to each other is not limited to that shown in FIG. 1, but may be set in accordance with the building in which the air-conditioning apparatus according to Embodiment 1 is installed.

Figure 2:
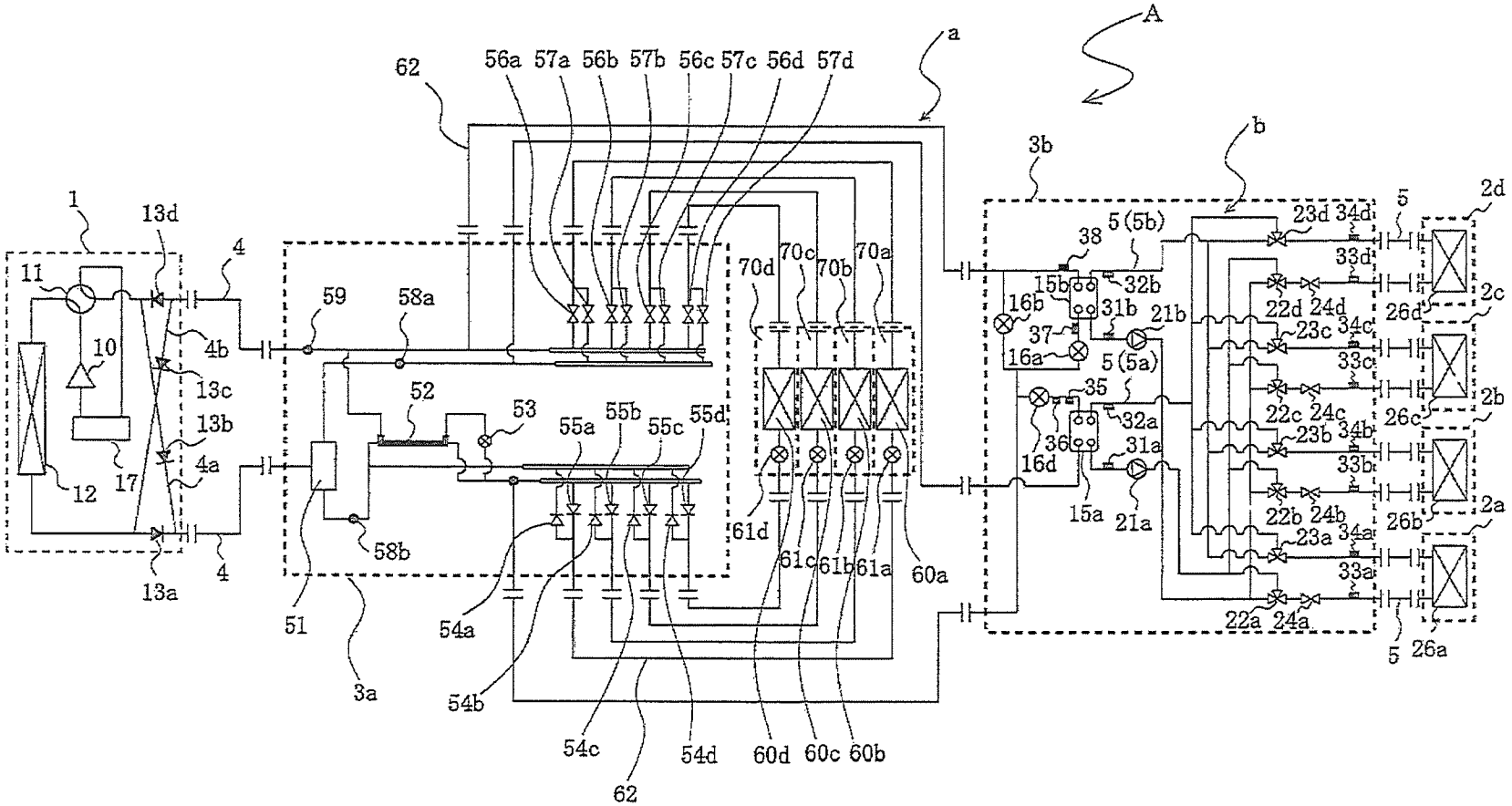
FIG. 2 is a schematic circuit configuration diagram showing an example of a circuit configuration of the air-conditioning apparatus according to Embodiment 1 of the invention.

FIG. 2 is a schematic circuit configuration diagram showing an example of a circuit configuration of the air-conditioning apparatus (referred to as "air-conditioning apparatus A" hereinafter) according to Embodiment 1. The circuit configuration of the air-conditioning apparatus A will be described in detail with reference to FIG. 2. As shown in FIG. 2, the outdoor unit 1 and the first heat medium relay unit 3*a* are connected to each other with the refrigerant piping 4; the first heat medium relay unit 3*a*, the refrigerant indoor units 70, and the second heat medium relay unit 3*b* are connected to each other with the refrigerant pipings 62; and the second heat medium relay unit 3*b* and the heat medium indoor units 2 are connected to each other with the heat medium pipings 5 via a heat exchanger related to heat medium 15*a* and a heat exchanger related to heat medium 15*b* provided in the second heat medium relay unit 3*b*.

Outdoor Unit 1

The outdoor unit 1 accommodates a compressor 10, a four-way valve 11 serving as a refrigerant flow switching device, a heat source side heat exchanger 12, and an accumulator 17 that are connected in series by the refrigerant piping 4. The outdoor unit 1 is also provided with a first connecting piping 4*a*, a second connecting piping 4*b*, a check valve 13*a*, a check valve 13*b*, a check valve 13*c*, and a check valve 13*d*. With the first connecting piping 4*a*, the second connecting piping 4*b*, the check valve 13*a*, the check valve 13*b*, the check valve 13*c*, and the check valve 13*d*, the heat source side refrigerant flowing into the first heat medium relay unit 3*a* can be made to flow in a constant direction.

The compressor 10 sucks in the heat source side refrigerant and sets the heat source side refrigerant to be in a high-temperature, high-pressure state by compressing it. The compressor 10 may be constituted by, for example, a capacity-controllable inverter compressor. The four-way valve 11 switches the flow of the heat source side refrigerant during heating operation (a heating only operation mode and a heating main operation mode) and the flow of the heat source side refrigerant during cooling operation (a cooling only operation mode and a cooling main operation mode). The heat source side heat exchanger 12 functions as an evaporator during the heating operation and functions as a condenser during the cooling operation, and exchanges heat between air supplied from an air-sending device, such as a fan (not shown), and the heat source side refrigerant, so as to evaporate and gasify the heat source side refrigerant or condense and liquefy the heat source side refrigerant. The accumulator 17 is provided at the suction side of the compressor 10 and retains excess refrigerant.

The check valve 13*d* is provided in the refrigerant piping 4 between the first heat medium relay unit 3*a* and the four-way valve 11 and allows the heat source side refrigerant to flow only in a predetermined direction (a direction from the first heat medium relay unit 3*a* toward the outdoor unit 1). The check valve 13*a* is provided in the refrigerant piping 4 between the heat source side heat exchanger 12 and the first heat medium relay unit 3*a* and allows the heat source side refrigerant to flow only in a predetermined direction (a direction from the outdoor unit 1 toward the first heat medium relay unit 3*a*). The check valve 13*b* is provided in the first connecting piping 4*a* and allows the heat source side refrigerant to flow only in a direction from the downstream side of the check valve 13*d* toward the downstream side of the check valve 13*a*. The check valve 13*c* is provided in the second connecting piping 4*b* and allows the heat source side refrigerant to flow only in a direction from the upstream side of the check valve 13*d* toward the upstream side of the check valve 13*a*.

The first connecting piping 4*a* connects the refrigerant piping 4 at the downstream side of the check valve 13*d* to the refrigerant piping 4 at the downstream side of the check valve 13*a* in the outdoor unit 1. The second connecting piping 4*b* connects the refrigerant piping 4 at the upstream side of the check valve 13*d* to the refrigerant piping 4 at the upstream side of the check valve 13*a* in the outdoor unit 1. Although FIG. 2 shows the example in which the first connecting piping 4*a*, the second connecting piping 4*b*, the check valve 13*a*, the check valve 13*b*, the check valve 13*c*, and the check valve 13*d* are provided, the invention is not limited to this example, and these components do not necessarily need to be provided.

Heat Medium Indoor Units 2

Each of the heat medium indoor units 2 is equipped with a use side heat exchanger (second use side heat exchanger) 26. The use side heat exchangers 26 are connected to heat medium flow control devices 24 and second heat medium flow switching devices 23 in the second heat medium relay unit 3*b* via the heat medium pipings 5. The use side heat exchangers 26 perform heat exchange between air supplied from an air-sending device, such as a fan (not shown), and the heat medium so as to generate heating air or cooling air to be supplied to a conditioned space (such as the room 100*c*).

The example shown in FIG. 2 corresponds to a case where four heat medium indoor units 2 are connected to the second heat medium relay unit 3*b* and include an indoor unit 2*a*, an indoor unit 2*b*, an indoor unit 2*c*, and an indoor unit 2*d* as viewed from the lower side of the drawing. In line with the indoor units 2*a* to 2*d*, the use side heat exchangers 26 similarly include a use side heat exchanger 26*a*, a use side heat exchanger 26*b*, a use side heat exchanger 26*c*, and a use side heat exchanger 26*d* as viewed from the lower side of the drawing. The number of connected heat medium indoor units 2 is not limited to three as shown in FIG. 1 or to four as shown in FIG. 2.

Refrigerant Indoor Units 70

The refrigerant indoor units 70 are each equipped with a use side heat exchanger (first use side heat exchanger) 60 and an expansion device 61 that are connected in series. The use side heat exchangers 60 and the expansion devices 61 are connected to the first heat medium relay unit 3*a* via the refrigerant pipings 62. The use side heat exchangers 60 perform heat exchange between air supplied from an air-sending device, such as a fan (not shown), and the heat source side refrigerant so as to generate heating air or cooling air to be supplied to a conditioned space (such as the server room 100*a*). Each expansion device 61 functions as a pressure reducing valve or an expansion valve, and expands the heat source side refrigerant by decompressing it. The expansion devices 61 may be constituted by, for example, electronic expansion valves whose opening degree can be variably controlled.

The example shown in FIG. 2 corresponds to a case where four refrigerant indoor units 70 are connected to the first heat medium relay unit 3*a* and include an indoor unit 70*a*, an indoor unit 70*b*, an indoor unit 70*c*, and an indoor unit 70*d* as viewed from the right side of the drawing. In line with the indoor units 70*a* to 70*d*, the use side heat exchangers 60 similarly include a use side heat exchanger 60*a*, a use side heat exchanger 60*b*, a use side heat exchanger 60*c*, and a use side heat exchanger 60*d* as viewed from the right side of the drawing, and the expansion devices 61 similarly include an expansion device 61*a*, an expansion device 61*b*, an expansion device 61*c*, and an expansion device 61*d* as viewed from the right side of the drawing. The number of connected refrigerant indoor units 70 is not limited to two as shown in FIG. 1 or to four as shown in FIG. 2.

First Heat Medium Relay Unit 3*a*

The first heat medium relay unit 3*a* is provided with a gas-liquid separator 51, an expansion device 53, a subcooling heat exchanger 52, on-off valves 56 disposed on a low-pressure gas piping 59 side, on-off valves 57 disposed on a high-pressure gas piping 58*a* (first passage) side, check valves 54 disposed in a returning direction from the refrigerant indoor units 70, and check valves 55 disposed in a direction toward the refrigerant indoor units 70. Therefore, the first heat medium relay unit 3*a* and the refrigerant indoor units 70 are connected to each other with the refrigerant pipings 62 via the check valves 54, the check valves 55, the on-off valves 56, and the on-off valves 57. The on-off valves 56 and the on-off valves 57 serve as a first flow switching device according to the invention. The check valves 54 and the check valves 55 serve as a second flow switching device according to the invention.

The gas-liquid separator 51 is connected to a single refrigerant piping 4 connected to the outdoor unit 1, and also to two refrigerant pipings defined by the high-pressure gas piping 58*a* and a high-pressure liquid piping 58*b* (second passage), and separates the heat source side refrigerant supplied from the outdoor unit 1 into a gas refrigerant and a liquid refrigerant. The expansion device 53 decompresses a portion of a high-pressure liquid refrigerant flowing in and diverging from the high-pressure liquid piping 58*b*. The subcooling heat exchanger 52 performs heat exchange between the high-pressure liquid refrigerant flowing through the high-pressure liquid piping 58*b* and the liquid refrigerant decompressed by the expansion device 53. Specifically, the refrigerant decompressed by the expansion device 53 is delivered to the subcooling heat exchanger 52 so as to ensure subcooling of the high-pressure liquid refrigerant flowing out from the gas-liquid separator 51.

The on-off valves 56 and the on-off valves 57 are selectively opened and closed so as to allow or not allow the heat source side refrigerant to pass therethrough. In line with the indoor units 70*a* to 70*d*, the on-off valves 56 include an on-off valve 56*a*, an on-off valve 56*b*, an on-off valve 56*c*, and an on-off valve 56*d* as viewed from the left side of the drawing. Likewise, in line with the indoor units 70*a* to 70*d*, the on-off valves 57 include an on-off valve 57*a*, an on-off valve 57*b*, an on-off valve 57*c*, and an on-off valve 57*d* as viewed from the left side of the drawing.

The check valves 54 only allow the heat source side refrigerant returning from the refrigerant indoor units 70 to pass therethrough. The check valves 55 only allow the heat source side refrigerant flowing toward the refrigerant indoor units 70 to pass therethrough. In line with the indoor units 70*a* to 70*d*, the check valves 54 include a check valve 54*a*, a check valve 54*b*, a check valve 54*c*, and a check valve 54*d* as viewed from the left side of the drawing. Likewise, in line with the indoor units 70*a* to 70*d*, the check valves 55 include a check valve 55*a*, a check valve 55*b*, a check valve 55*c*, and a check valve 55*d* as viewed from the left side of the drawing.

Figure 7:
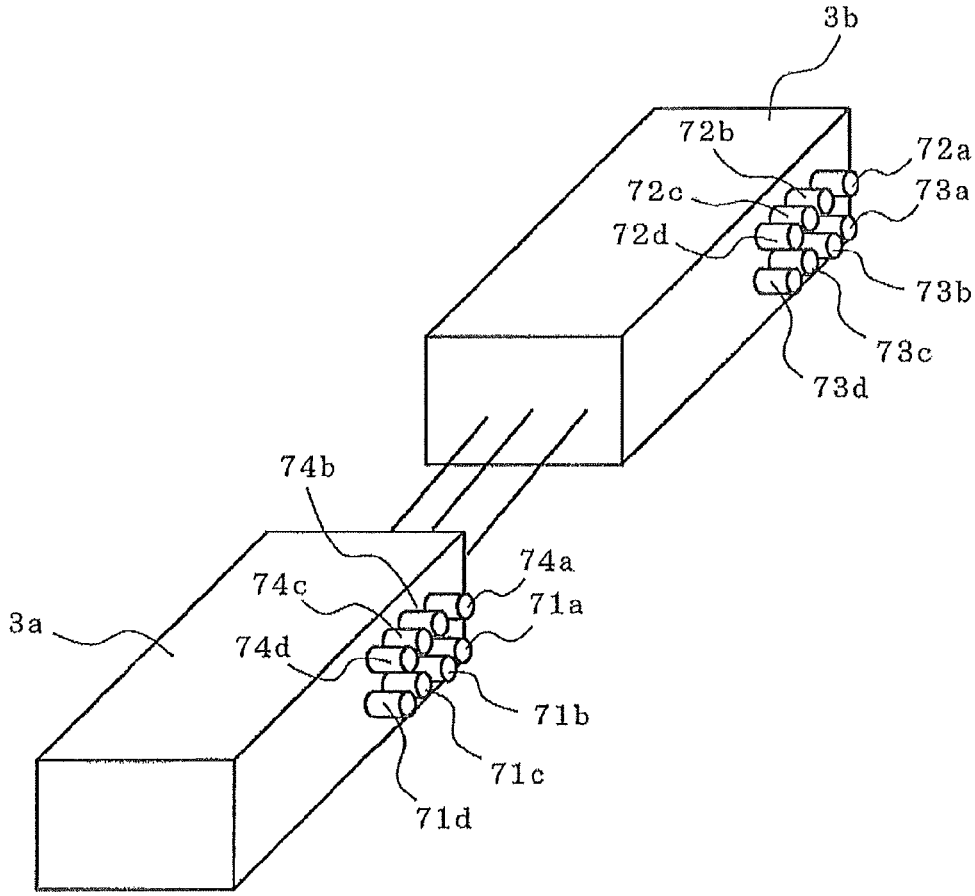
FIG. 7 schematically illustrates an example of heat medium relay units in a connected state.

As shown in FIG. 7, the first heat medium relay unit 3*a* is provided with connection ports 74 (shown as connection ports 74*a* to 74*d* corresponding to the use side heat exchangers 60) and connection ports 71 (shown as connection ports 71*a* to 71*d* corresponding to the use side heat exchangers 60), for connecting to the use side heat exchangers 60. The connection ports 74 function as connection ports connected to supply pipings extending from the first heat medium relay unit 3*a* toward the use side heat exchangers 60, and the connection ports 71 function as connection ports connected to return pipings extending from the use side heat exchangers 60 toward the first heat medium relay unit 3*a*.

Second Heat Medium Relay Unit 3*b*

The second heat medium relay unit 3*b* is provided with two heat exchangers related to heat medium 15, three expansion devices 16, two heat medium sending devices 21, four first heat medium flow switching devices 22, four second heat medium flow switching devices 23, and four heat medium flow control devices 24.

Each of the two heat exchangers related to heat medium 15 (the first heat exchanger related to heat medium 15*a* and the second heat exchanger related to heat medium 15*b*) functions as a condenser (radiator) or an evaporator, exchanges heat between the heat source side refrigerant and the heat medium, and conveys the cooling energy or heating energy generated in the outdoor unit 1 to the heat medium so as to supply the cooling energy or heating energy to the heat medium indoor units 2. The first heat exchanger related to heat medium 15*a* is connected to the first heat medium relay unit 3*a* via the high-pressure gas piping 58*a* and is used for heating the heat medium during a cooling and heating mixed operation mode. The second heat exchanger related to heat medium 15*b* is connected to the first heat medium relay unit 3*a* via the low-pressure gas piping 59 and is used for cooling the heat medium during the cooling and heating mixed operation mode.

Each of the three expansion devices 16 (an expansion device 16*a*, an expansion device 16*b*, and an expansion device 16*d*) functions as a pressure reducing valve or an expansion valve, and expands the heat source side refrigerant by decompressing it. The expansion device 16*a* is provided between the expansion device 16*d* and the second heat exchanger related to heat medium 15*b*. The expansion device

16*b* is provided in parallel with the expansion device 16*a*. The expansion device 16*d* is provided between the first heat exchanger related to heat medium 15*a* and the expansion devices 16*a* and 16*b*. The three expansion devices 16 may be constituted by, for example, electronic expansion valves whose opening degree can be variably controlled.

The two heat medium sending devices 21 (a first heat medium sending device 21*a* and a second heat medium sending device 21*b*) are constituted by pumps or the like, and apply pressure to the heat medium guided through the heat medium pipings 5 so as to cause the heat medium to circulate therethrough. The first heat medium sending device 21*a* is provided in the heat medium piping 5 located between the first heat exchanger related to heat medium 15*a* and the first heat medium flow switching devices 22. The second heat medium sending device 21*b* is provided in the heat medium piping 5 located between the second heat exchanger related to heat medium 15*b* and the first heat medium flow switching devices 22. The first heat medium sending device 21*a* and the second heat medium sending device 21*b* are not particularly limited to a particular type, and they may be constituted by, for example, capacity-controllable pumps.

The four first heat medium flow switching devices 22 (first heat medium flow switching devices 22*a* to 22*d*) are constituted by three-way valves or the like and are provided for switching the passages of the heat medium. The number of first heat medium flow switching devices 22 (four, in this case) is set so as to correspond to the number of the heat medium indoor units 2. With regard to each of the first heat medium flow switching devices 22, one side of the three-way valve is connected to the first heat exchanger related to heat medium 15*a*, another side of the three-way valve is connected to the second heat exchanger related to heat medium 15*b*, and the remaining side of the three-way valve is connected to the corresponding heat medium flow control device 24. The first heat medium flow switching devices 22 are provided on the inlet side of the heat medium passages of the use side heat exchangers 26. In line with the heat medium indoor units 2, the first heat medium flow switching devices 22 include a heat medium flow switching device 22*a*, a heat medium flow switching device 22*b*, a heat medium flow switching device 22*c*, and a heat medium flow switching device 22*d* as viewed from the lower side of the drawing.

The four second heat medium flow switching devices 23 (second heat medium flow switching devices 23*a* to 23*d*) are constituted by three-way valves or the like and are provided for switching the passages of the heat medium. The number of second heat medium flow switching devices 23 (four, in this case) is set so as to correspond to the number of the heat medium indoor units 2. With regard to each of the second heat medium flow switching devices 23, one side of the three-way valve is connected to the first heat exchanger related to heat medium 15*a*, another side of the three-way valve is connected to the second heat exchanger related to heat medium 15*b*, and the remaining side of the three-way valve is connected to the corresponding use side heat exchanger 26. The second heat medium flow switching devices 23 are provided on the outlet side of the heat medium passages of the use side heat exchangers 26. In line with the heat medium indoor units 2, the second heat medium flow switching devices 23 include a heat medium flow switching device 23*a*, a heat medium flow switching device 23*b*, a heat medium flow switching device 23*c*, and a heat medium flow switching device 23*d* as viewed from the lower side of the drawing.

Each of the four heat medium flow control devices 24 (heat medium flow control devices 24*a* to 24*d*) is constituted by, for example, a two-way valve that can control the opening area, and is provided for controlling the flow rate of the heat medium. The number of heat medium flow control devices 24 (four, in this case) is set so as to correspond to the number of the heat medium indoor units 2. With regard to each of the four heat medium flow control devices 24, one side is connected to the corresponding use side heat exchanger 26, and the other side is connected to the corresponding first heat medium flow switching device 22. The heat medium flow control devices 24 are provided on the inlet side of the heat medium passages of the use side heat exchangers 26. In line with the heat medium indoor units 2, the heat medium flow control devices 24 include a heat medium flow control device 24*a*, a heat medium flow control device 24*b*, a heat medium flow control device 24*c*, and a heat medium flow control device 24*d* as viewed from the lower side of the drawing. Alternatively, the heat medium flow control devices 24 may be provided on the outlet side of the heat medium passages of the use side heat exchangers 26.

As shown in FIG. 7, the second heat medium relay unit 3*b* is provided with connection ports 72 (shown as connection ports 72*a* to 72*d* corresponding to the use side heat exchangers 26) and connection ports 73 (shown as connection ports 73*a* to 73*d* corresponding to the use side heat exchangers 26), for connecting to the use side heat exchangers 26. The connection ports 72 function as connection ports connected to supply pipings extending from the second heat medium relay unit 3*b* toward the use side heat exchangers 26, and the connection ports 73 function as connection ports connected to return pipings extending from the use side heat exchangers 26 toward the second heat medium relay unit 3*b*.

Furthermore, the second heat medium relay unit 3*b* is provided with two first heat medium temperature detecting means 31, two second heat medium temperature detecting means 32, four third heat medium temperature detecting means 33, four fourth heat medium temperature detecting means 34, first refrigerant temperature detecting means 35, refrigerant pressure detecting means 36, second refrigerant temperature detecting means 37, and third refrigerant temperature detecting means 38. Information (such as temperature information and pressure information) detected by these detecting means is sent to a controller (not shown) that controls the operation of the air-conditioning apparatus A, so as to be used for controlling the driving frequency of the compressor 10 and the heat medium sending devices 21, the rotation speed of the air-sending devices (not shown), the switching of the four-way valve 11, and the switching of the heat medium passages.

The two first heat medium temperature detecting means 31 (first heat medium temperature detecting means 31*a* and first heat medium temperature detecting means 31*b*) detect the temperature of the heat medium flowing out from the heat exchangers related to heat medium 15, that is, the heat medium at the outlets of the heat exchangers related to heat medium 15, and may be constituted by, for example, thermistors. The first heat medium temperature detecting means 31*a* is provided in the heat medium piping 5 located on the inlet side of the first heat medium sending device 21*a*. The first heat medium temperature detecting means 31*b* is provided in the heat medium piping 5 located on the heat medium inlet side of the second heat medium sending device 21*b*.

The two second heat medium temperature detecting means 32 (second heat medium temperature detecting means 32*a* and second heat medium temperature detecting means 32*b*) detect the temperature of the heat medium flowing into the heat exchangers related to heat medium 15, that is, the heat medium at the inlets of the heat exchangers related to heat medium 15, and may be constituted by, for example, thermistors. The second heat medium temperature detecting means 32*a* is provided in the heat medium piping 5 located on the inlet side of the first heat exchanger related to heat medium 15*a*. The second heat medium temperature detecting means 32*b* is provided in the corresponding heat medium piping 5 located on the inlet side of the second heat exchanger related to heat medium 15*b*.

The four third heat medium temperature detecting means 33 (third heat medium temperature detecting means 33*a* to third heat medium temperature detecting means 33*d*) are provided on the inlet side of the heat medium passages of the use side heat exchangers 26 so as detect the temperature of the heat medium flowing into the use side heat exchangers 26, and may be constituted by, for example, thermistors. The number of third heat medium temperature detecting means 33 (four, in this case) is set so as to correspond to the number of the heat medium indoor units 2. In line with the heat medium indoor units 2, the third heat medium temperature detecting means 33 include third heat medium temperature detecting means 33*a*, third heat medium temperature detecting means 33*b*, third heat medium temperature detecting means 33*c*, and third heat medium temperature detecting means 33*d* as viewed from the lower side of the drawing.

The four fourth heat medium temperature detecting means 34 (fourth heat medium temperature detecting means 34*a* to fourth heat medium temperature detecting means 34*d*) are provided on the outlet side of the heat medium passages of the use side heat exchangers 26 so as detect the temperature of the heat medium flowing out from the use side heat exchangers 26, and may be constituted by, for example, thermistors. The number of fourth heat medium temperature detecting means 34 (four, in this case) is set so as to correspond to the number of the heat medium indoor units 2. In line with the heat medium indoor units 2, the fourth heat medium temperature detecting means 34 include fourth heat medium temperature detecting means 34*a*, fourth heat medium temperature detecting means 34*b*, fourth heat medium temperature detecting means 34*c*, and fourth heat medium temperature detecting means 34*d* as viewed from the lower side of the drawing.

The first refrigerant temperature detecting means 35 is provided on the outlet side of a heat source side refrigerant passage of the first heat exchanger related to heat medium 15*a*, that is, between the first heat exchanger related to heat medium 15*a* and the expansion device 16*d*, so as to detect the temperature of the heat source side refrigerant flowing out from the first heat exchanger related to heat medium 15*a*, and may be constituted by, for example, a thermistor. The refrigerant pressure detecting means 36 is provided on the outlet side of the heat source side refrigerant passage of the first heat exchanger related to heat medium 15*a*, that is, between the first heat exchanger related to heat medium 15*a* and the expansion device 16*d*, so as to detect the pressure of the heat source side refrigerant flowing out from the first heat exchanger related to heat medium 15*a*, and may be constituted by a pressure sensor or the like.

The second refrigerant temperature detecting means 37 is provided on the inlet side of a heat source side refrigerant passage of the second heat exchanger related to heat medium 15*b*, that is, between the expansion device 16*a* and the second heat exchanger related to heat medium 15*b*, so as to detect the temperature of the heat source side refrigerant flowing into the second heat exchanger related to heat medium 15*b*, and may be constituted by, for example, a thermistor. The third refrigerant temperature detecting means 38 is provided on the outlet side of the heat source side refrigerant passage of the second heat exchanger related to heat medium 15*b*, that is, in the refrigerant piping 62 connected to the low-pressure gas piping 59, so as to detect the temperature of the heat source side refrigerant flowing out from the second heat exchanger related to heat medium 15*b*, and may be constituted by a thermistor or the like.

The controller (not shown) is constituted by a microcomputer or the like and controls the driving frequency of the compressor 10, the rotation speed of the air-sending devices (including ON/OFF operation), the switching of the four-way valve 11, the driving of the heat medium sending devices 21, the opening degrees of the expansion devices 16, the switching of the first heat medium flow switching devices 22, the switching of the second heat medium flow switching devices 23, and the driving of the heat medium flow control devices 24 on the basis of detection information of the various detecting means and a command from a remote controller, so as to perform various operation modes described later. The controller may be provided for each unit, or may be collectively provided in the outdoor unit 1 or the heat medium relay units 3.

The heat medium pipings 5 that guide the heat medium include a piping (referred to as "piping 5*a*" hereinafter) connected to the first heat exchanger related to heat medium 15*a* and a piping (referred to as "piping 5*b*" hereinafter) connected to the second heat exchanger related to heat medium 15*b*. The piping 5*a* and the piping 5*b* each branch into piping segments (four piping segments, in this case) in accordance with the number of the heat medium indoor units 2 connected to the heat medium relay unit 3. The piping 5*a* and the piping 5*b* are connected via the first heat medium flow switching devices 22 and the second heat medium flow switching devices 23. Control of the first heat medium flow switching devices 22 and the second heat medium flow switching devices 23 determines whether the heat medium guided through the piping 5*a* is to be made to flow into the use side heat exchangers 26 or whether the heat medium guided through the piping 5*b* is to be made to flow into the use side heat exchangers 26.

In the air-conditioning apparatus A, the compressor 10, the four-way valve 11, the heat source side heat exchanger 12, the gas-liquid separator 51, the on-off valves 56, the on-off valves 57, the check valves 54, the check valves 55, the use side heat exchangers 60, the expansion devices 61, the first heat exchanger related to heat medium 15*a*, the second heat exchanger related to heat medium 15*b*, and the expansion devices 16 are connected by refrigerant piping 4 (including the high-pressure gas piping 58*a*, the high-pressure liquid piping 58*b*, and the low-pressure gas piping 59) so as to constitute a refrigeration cycle, that is, the refrigerant circuit a.

Furthermore, the first heat exchanger related to heat medium 15*a*, the first heat medium sending device 21*a*, the first heat medium flow switching devices 22, the heat medium flow control devices 24, the use side heat exchangers 26, and the second heat medium flow switching devices 23 are connected in series in turn by piping 5*a* so as to constitute the heat medium circuit b. Similarly, the second heat exchanger related to heat medium 15*b*, the second heat medium sending device 21*b*, the first heat medium flow switching devices 22, the heat medium flow control devices 24, the use side heat exchangers 26, and the second heat medium flow switching devices 23 are connected in series in turn by piping 5*b* so as to constitute the heat medium circuit b. In other words, the a plurality of use side heat exchangers 26 are connected in parallel to each of the heat exchangers related to heat medium 15 thus turning the heat medium circuit b into a multi-system.

Specifically, the first heat medium relay unit 3*a* and the second heat medium relay unit 3*b* are connected to each other via the first heat exchanger related to heat medium 15*a* and the second heat exchanger related to heat medium 15*b* provided in the second heat medium relay unit 3*b*. Moreover, the second heat medium relay unit 3*b* and the heat medium indoor units 2 are connected to each other via the first heat exchanger related to heat medium 15*a* and the second heat exchanger related to heat medium 15*b*, and the heat source side refrigerant, which is a primary refrigerant circulating through the refrigerant circuit a, and the heat medium, which is a secondary refrigerant circulating through the heat medium circuit b, exchange heat in the first heat exchanger related to heat medium 15*a* and the second heat exchanger related to heat medium 15*b*.

The types of heat source side refrigerant that can be used in the refrigerant circuit a and the types of heat medium that can be used in the heat medium circuit b will now be described.

In the refrigerant circuit a, a non azeotropic refrigerant mixture, such as R407C, a near-azeotropic refrigerant mixture, such as R410A, or a single mixed refrigerant, such as R22, may be used. Alternatively, a natural refrigerant, such as carbon dioxide or hydrocarbon, may be used. Using a natural refrigerant as a heat source side refrigerant advantageously reduces global greenhouse effect caused by refrigerant leakage.

As described above, the heat medium circuit b is connected to the use side heat exchangers 26 of the heat medium indoor units 2. Therefore, in view of a case in which the heat medium leak into the room 100*c* where the heat medium indoor units 2 are installed, usage of a safe heat medium is a precondition of the air-conditioning apparatus A. Accordingly, the heat medium used may be water, antifreeze, or a mixture of water and antifreeze. With this configuration, the occurrence of refrigerant leakage caused by corrosion or freezing can be reduced even when the outside temperature is low, thereby achieving high reliability.

The various operation modes executed by the air-conditioning apparatus A will now be described. The air-conditioning apparatus A is capable of performing cooling operation or heating operation in each heat medium indoor unit 2 and each refrigerant indoor unit 70 on the basis of a command from the heat medium indoor unit 2 and a command from the refrigerant indoor unit 70. Specifically, the air-conditioning apparatus A can perform the same operation in all of the heat medium indoor units 2 and the refrigerant indoor units 70, or perform different operations among the heat medium indoor units 2 and the refrigerant indoor units 70.

The operation modes executed by the air-conditioning apparatus A include a cooling only operation mode in which the heat medium indoor units 2 and refrigerant indoor units 70 that are in operation all perform the cooling operation, a heating only operation mode in which the heat medium indoor units 2 and refrigerant indoor units 70 that are in operation all perform the heating operation, a cooling main operation mode in which the cooling load is greater, and a heating main operation mode in which the heating load is greater. Each operation mode will be described below along with the flow of the heat source side refrigerant and the heat medium.

Cooling Main Operation Mode

Figure 3:
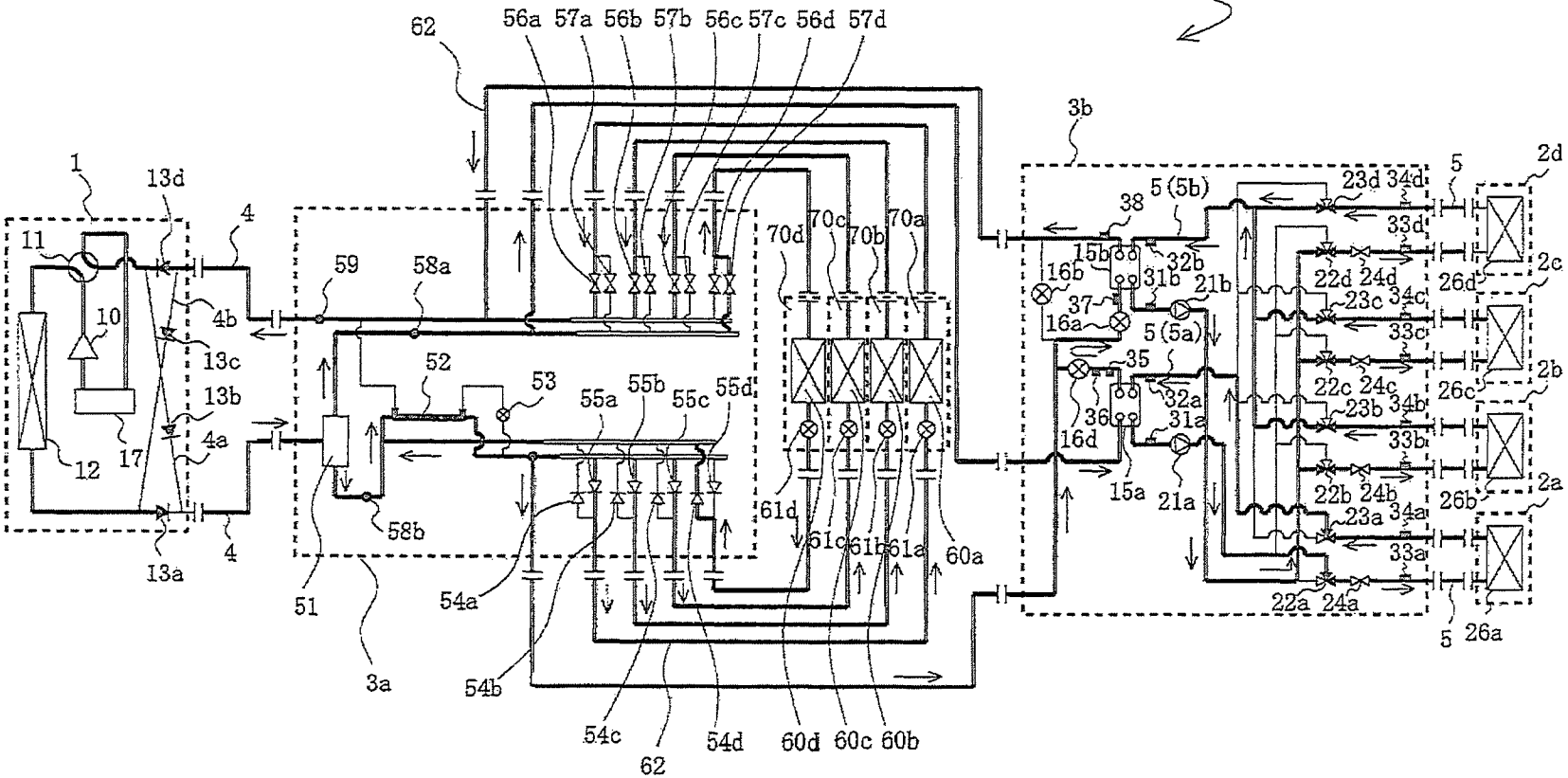
FIG. 3 is a refrigerant circuit diagram illustrating the flow of refrigerants during a cooling main operation mode of the air-conditioning apparatus according to Embodiment 1 of the invention.

FIG. 3 is a refrigerant circuit diagram illustrating the flow of the refrigerants during the cooling main operation mode of the air-conditioning apparatus A. In FIG. 3, the cooling main operation mode will be described with an example where heating load is generated in the use side heat exchanger 26*a* and the use side heat exchanger 60*d*, and cooling load is generated in the use side heat exchangers 26*b* to 26*d* and the use side heat exchangers 60*a* to 60*c*. In FIG. 3, pipings depicted by thick lines are pipings through which the refrigerants (the heat source side refrigerant and the heat medium) circulate. Furthermore, in FIG. 3, the flowing directions of the heat source side refrigerant and the heat medium are indicated by arrows.

In the cooling main operation mode shown in FIG. 3, in the outdoor unit 1, the four-way valve 11 is switched so that the heat source side refrigerant discharged from the compressor 10 flows into the heat source side heat exchanger 12. In the second heat medium relay unit 3*b*, the first heat medium sending device 21*a* and the second heat medium sending device 21*b* are driven, the heat medium flow control devices 24 are opened, and the first heat medium flow switching devices 22 and the second heat medium flow switching devices 23 are controlled, so that the heat medium circulates between the first heat exchanger related to heat medium 15*a* and the use side heat exchanger 26*a*, as well as between the second heat exchanger related to heat medium 15*b* and the use side heat exchangers 26*b* to 26*d*. In the first heat medium relay unit 3*a*, the expansion device 53 is closed, the on-off valves 56*a* to 56*c* are opened, the on-off valve 56*d* is closed, the on-off valves 57*a* to 57*c* are closed, and the on-off valve 57*d* is opened.

First, the flow of the heat source side refrigerant in the refrigerant circuit a will be described.

A low-temperature, low-pressure refrigerant is compressed by the compressor 10 so that a high-temperature, high-pressure gas refrigerant is discharged therefrom. The high-temperature, high-pressure gas refrigerant discharged from the compressor 10 passes through the four-way valve 11 so as to flow into the heat source side heat exchanger 12. Then, the high-temperature, high-pressure gas refrigerant is condensed in the heat source side heat exchanger 12 while transferring heat to outdoor air, thereby turning into a two-phase gas-liquid refrigerant. The two-phase gas-liquid refrigerant flowing out from the heat source side heat exchanger 12 passes through the check valve 13*a* so as to flow out from the outdoor unit 1, and then travels through the refrigerant piping 4 so as to flow into the first heat medium relay unit 3*a*. The two-phase gas-liquid refrigerant flowing into the first heat medium relay unit 3*a* flows into the gas-liquid separator 51 so as to be separated into a gas refrigerant and a liquid refrigerant.

A portion of the gas refrigerant separated by the gas-liquid separator 51 travels through the high-pressure gas piping 58*a* so as to flow into the first heat exchanger related to heat medium 15*a* in the second heat medium relay unit 3*b*. The gas refrigerant flowing into the first heat exchanger related to heat medium 15*a* is condensed and liquefied therein while transferring heat to the heat medium circulating through the heat medium circuit b, thereby turning into a liquid refrigerant. The liquid refrigerant flowing out from the first heat exchanger related to heat medium 15*a* travels through the expansion device 16*d*. On the other hand, the liquid refrigerant separated by the gas-liquid separator 51 flows into the second heat medium relay unit 3*b* via the high-pressure liquid piping 58*b* and merges with the liquid refrigerant flowing from the first heat exchanger related to heat medium 15*a* and the expansion device 16*d*.

The merged liquid refrigerant is throttled and expanded by the expansion device 16*a*, and flows into the second heat exchanger related to heat medium 15*b* as a low-temperature, low-pressure two-phase gas-liquid refrigerant. The two-phase gas-liquid refrigerant receives heat from the heat medium circulating through the heat medium circuit b at the second heat exchanger related to heat medium 15*b* functioning as an evaporator, so as to turn into a low-temperature, low-pressure gas refrigerant while cooling the heat medium. The gas refrigerant flowing out from the second heat exchanger related to heat medium 15*b* flows out from the second heat medium relay unit 3*b* and travels through the low-pressure gas piping 59 and the refrigerant piping 4 via the first heat medium relay unit 3*a* so as to flow into the outdoor unit 1. The refrigerant flowing into the outdoor unit 1 passes through the check valve 13*d* so as to be sucked into the compressor 10 again via the four-way valve 11 and the accumulator 17.

The high-pressure liquid refrigerant separated by the gas-liquid separator 51 travels through the high-pressure liquid piping 58*b*, and a portion thereof flows into the second heat medium relay unit 3*b* while the remaining high-pressure liquid refrigerant passes through the check valves 55*a* to 55*c* and is decompressed by the expansion devices 61*a* to 61*c* so as to turn into a low-pressure two-phase gas-liquid refrigerant. The low-pressure two-phase gas-liquid refrigerant flows into the use side heat exchangers 60*a* to 60*c* where the refrigerant absorbs heat (cools the surrounding air) and evaporates into a low-pressure gas refrigerant. After passing through the on-off valves 56*a* to 56*c*, the low-pressure gas refrigerant merges with the low-pressure gas refrigerant from the second heat medium relay unit 3*b* and flows into the outdoor unit 1 via the low-pressure gas piping 59 and the refrigerant piping 4.

On the other hand, the remaining high-pressure gas refrigerant separated by the gas-liquid separator 51 travels through the high-pressure gas piping 58*a* and the on-off valve 57*d* so as to flow into the use side heat exchanger 60*d* where the refrigerant transfers heat ((heats the surrounding air) and is condensed into a high-pressure liquid refrigerant. The high-pressure liquid refrigerant flows into the first heat medium relay unit 3*a* via the expansion device 61*d* and the check valve 54*d* and merges with the high-pressure liquid refrigerant separated by the gas-liquid separator 51.

With the functions of the expansion devices 61*a* to 61*d*, the heat source side refrigerant used in the cooling operation and the heating operation is made to flow into the use side heat exchangers 60*a* to 60*d* with the amount that is sufficient enough to cover the air conditioning load required in the conditioned space.

Next, the flow of the heat medium in the heat medium circuit b will be described.

The heat medium pressurized in and flowing out from the first heat medium sending device 21*a* travels through the heat medium flow control device 24*a* via the first heat medium flow switching device 22*a* so as to flow into the use side heat exchanger 26*a*. Then, the heat medium transfers heat to indoor air at the use side heat exchanger 26*a* so as to heat the room 100*c* where the heat medium indoor units 2 are installed. On the other hand, the heat medium pressurized in and flowing out from the second heat medium sending device 21*b* travels through the heat medium flow control devices 24*b* to 24*d* via the first heat medium flow switching devices 22*b* to 22*d* so as to flow into the use side heat exchangers 26*b* to 26*d*. Then, the heat medium receives heat from indoor air at the use side heat exchangers 26*b* to 26*d* so as to cool the room 100*c* where the heat medium indoor units 2 are installed.

With the function of the heat medium flow control device 24*a*, the heat medium used in the heating operation is made to flow into the use side heat exchanger 26*a* with the amount that is sufficient enough to cover the air conditioning load required in the conditioned space such as the room 100*c*. The heat medium, after the heating operation, flows into the first heat exchanger related to heat medium 15*a* via the second heat medium flow switching device 23*a* so as to be sucked into the first heat medium sending device 21*a* again.

With the functions of the heat medium flow control devices 24*b* to 24*d*, the heat medium used in the cooling operation is made to flow into the use side heat exchangers 26*b* to 26*d* with the amount that is sufficient enough to cover the air conditioning load required in the conditioned space such as the room 100*c*. The heat medium, after the cooling operation, flows into the second heat exchanger related to heat medium 15*b* via the second heat medium flow switching devices 23*b* to 23*d* so as to be sucked into the second heat medium sending device 21*b* again.

Heating Main Operation Mode

Figure 4:
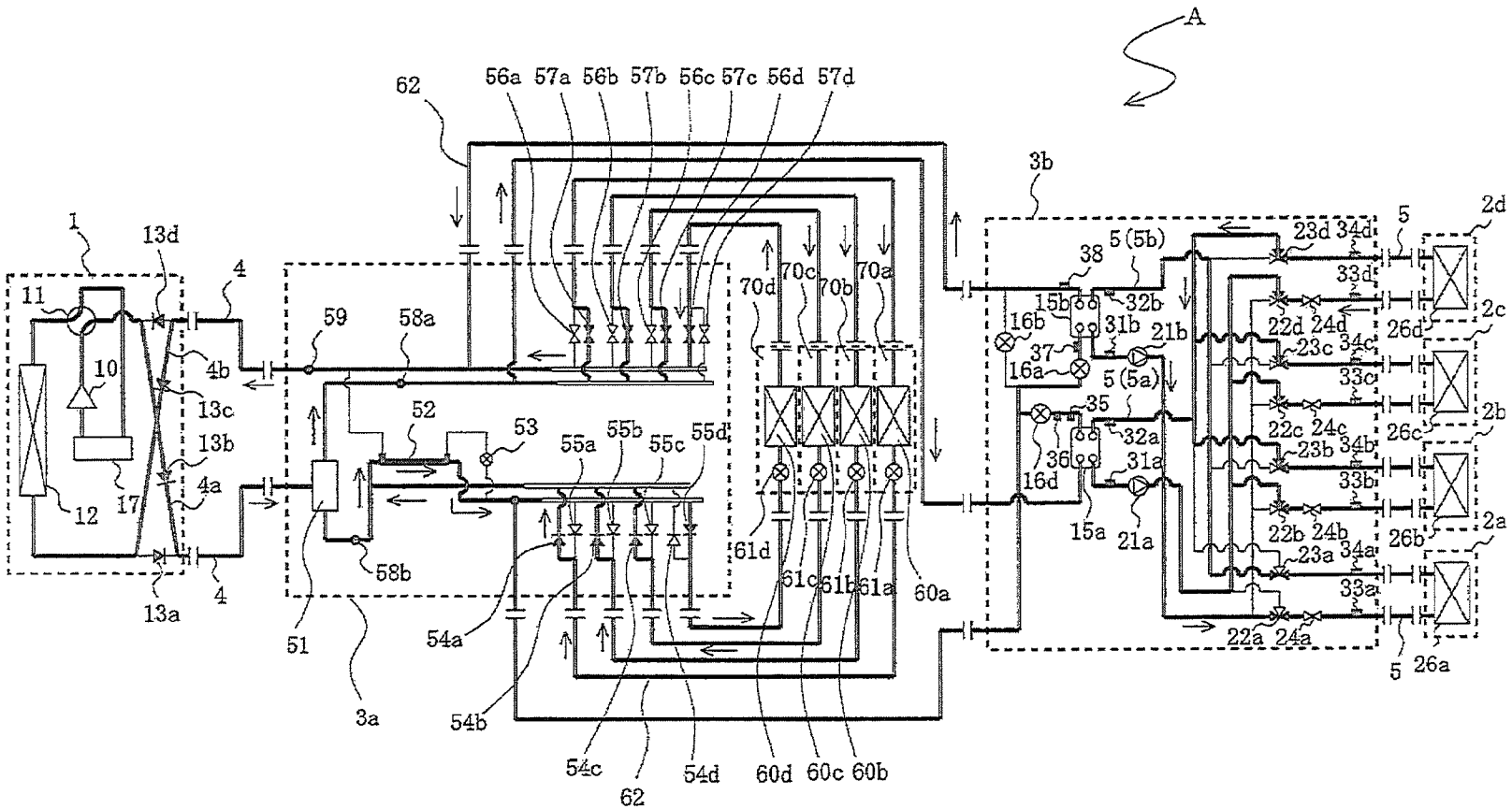
FIG. 4 is a refrigerant circuit diagram illustrating the flow of the refrigerants during a heating main operation mode of the air-conditioning apparatus according to Embodiment 1 of the invention.

FIG. 4 is a refrigerant circuit diagram illustrating the flow of the refrigerants during the heating main operation mode of the air-conditioning apparatus A. In FIG. 4, the heating main operation mode will be described with an example where cooling load is generated in the use side heat exchanger 26*a* and the use side heat exchanger 60*d*, and heating load is generated in the use side heat exchangers 26*b* to 26*d* and the use side heat exchangers 60*a* to 60*c*. In FIG. 4, pipings depicted by thick lines are pipings through which the refrigerants (the heat source side refrigerant and the heat medium) circulate. Furthermore, in FIG. 4, the flowing directions of the heat source side refrigerant and the heat medium are indicated by arrows.

In the heating main operation mode shown in FIG. 4, in the outdoor unit 1, the four-way valve 11 is switched so as to cause the heat source side refrigerant discharged from the compressor 10 to flow into the first heat medium relay unit 3*a* without passing through the heat source side heat exchanger 12. In the second heat medium relay unit 3*b*, the first heat medium sending device 21*a* and the second heat medium sending device 21*b* are driven, the heat medium flow control devices 24 are opened, and the first heat medium flow switching devices 22 and the second heat medium flow switching devices 23 are controlled, so that the heat medium circulates between the first heat exchanger related to heat medium 15*a* and the use side heat exchangers 26*b* to 26*d*, as well as between the second heat exchanger related to heat medium 15*b* and the use side heat exchanger 26*a*. In the first heat medium relay unit 3*a*, the expansion device 53 is set to be in a closed state or to a small opening degree, the on-off valves 56*a* to 56*c* are closed, the on-off valve 56*d* is opened, the on-off valves 57*a* to 57*c* are opened, and the on-off valve 57*d* is closed.

First, the flow of the heat source side refrigerant in the refrigerant circuit a will be described.

A low-temperature, low-pressure refrigerant is compressed by the compressor 10 so that a high-temperature, high-pressure gas refrigerant is discharged therefrom. The high-temperature, high-pressure gas refrigerant discharged from the compressor 10 passes through the four-way valve 11 so as to flow out from the outdoor unit 1 via the check valve 13*b*. The refrigerant flowing out from the outdoor unit 1 flows into the first heat medium relay unit 3*a* via the refrigerant piping 4. In the refrigerant piping 4, a portion of the gas refrigerant is liquefied, and the refrigerant flowing into the first heat medium relay unit 3*a* flows into the gas-liquid separator 51 so as to be separated into a gas refrigerant and a liquid refrigerant. Then, the gas refrigerant travels through the high-pressure gas piping 58*a*, and a portion thereof flows out from the first heat medium relay unit 3*a*.

The high-pressure gas refrigerant flowing out from the first heat medium relay unit 3*a* flows into the first heat exchanger related to heat medium 15*a* in the second heat medium relay unit 3*b*. The gas refrigerant flowing into the first heat exchanger related to heat medium 15*a* is condensed and liquefied therein while transferring heat to the heat medium circulating through the heat medium circuit b, thereby turning into a liquid refrigerant. The liquid refrigerant flowing out from the first heat exchanger related to heat medium 15*a* travels through the expansion device 16*d* where the liquid refrigerant is decompressed and expanded, thereby turning into a low-temperature, low-pressure two-phase gas-liquid refrigerant. On the other hand, the liquid refrigerant separated by the gas-liquid separator 51 flows into the second heat medium relay unit 3*b* via the high-pressure liquid piping 58*b* and merges with the two-phase gas-liquid refrigerant flowing from the first heat exchanger related to heat medium 15*a* and the expansion device 16*d*.

The merged two-phase gas-liquid refrigerant flows into the second heat exchanger related to heat medium 15*b*. This two-phase gas-liquid refrigerant receives heat from the heat medium circulating through the heat medium circuit b at the second heat exchanger related to heat medium 15*b* functioning as an evaporator, so as to flow out from the second heat exchanger related to heat medium 15*b* in a two-phase gas-liquid state while cooling the heat medium. The two-phase gas-liquid refrigerant flowing out from the second heat exchanger related to heat medium 15*b* flows out from the second heat medium relay unit 3*b* and then travels through the low-pressure gas piping 59 and the refrigerant piping 4 via the first heat medium relay unit 3*a* so as to flow into the outdoor unit 1. The refrigerant flowing into the outdoor unit 1 flows into the heat source side heat exchanger 12 via the check valve 13*c*. The two-phase gas-liquid refrigerant flowing into the heat source side heat exchanger 12 turns into a low-pressure gas refrigerant while cooling the surrounding air, and is sucked into the compressor 10 again via the four-way valve 11 and the accumulator 17.

The remaining high-pressure gas refrigerant separated by the gas-liquid separator 51 passes through the on-off valves 57*a* to 57*c* so as to flow into the use side heat exchangers 60*a* to 60*c* where the refrigerant transfers heat (heats the surrounding air) and condenses into a high-pressure liquid refrigerant. The high-pressure liquid refrigerant flows into the first heat medium relay unit 3*a* via the expansion devices 61*a* to 61*c* and the check valves 54*a* to 54*c* and merges with the high-pressure liquid refrigerant separated by the gas-liquid separator 51. The merged high-pressure liquid refrigerant travels through the subcooling heat exchanger 52 and the check valve 55*d* and is decompressed by the expansion device 61*d* so as to turn into a low-pressure two-phase gas-liquid refrigerant. The low-pressure two-phase gas-liquid refrigerant flows into the use side heat exchanger 60*d* where the refrigerant turns into a low-pressure gas refrigerant while cooling the surrounding air, and flows out from the use side heat exchanger 60*d*. The two-phase gas-liquid refrigerant flowing out from the use side heat exchanger 60*d* flows into the first heat medium relay unit 3*a* and merges with the refrigerant from the second heat medium relay unit 3*b* before flowing into the outdoor unit 1.

With the functions of the expansion devices 61*a* to 61*d*, the heat source side refrigerant used in the cooling operation and the heating operation is made to flow into the use side heat exchangers 60*a* to 60*d* with the amount that is sufficient enough to cover the air conditioning load required in the conditioned space.

Next, the flow of the heat medium in the heat medium circuit b will be described.

The heat medium pressurized in and flowing out from the first heat medium sending device 21*a* travels through the heat medium flow control devices 24*b* to 24*d* via the first heat medium flow switching devices 22*b* to 22*d* so as to flow into the use side heat exchangers 26*b* to 26*d*. Then, the heat medium transfers heat to indoor air at the use side heat exchangers 26*b* to 26*d* so as to heat the room 100*c* where the heat medium indoor units 2 are installed. On the other hand, the heat medium pressurized in and flowing out from the second heat medium sending device 21*b* travels through the heat medium flow control device 24*a* via the first heat medium flow switching device 22*a* so as to flow into the use side heat exchanger 26*a*. Then, the heat medium receives heat from indoor air at the use side heat exchanger 26*a* so as to cool the room 100*c* where the heat medium indoor units 2 are installed.

With the functions of the heat medium flow control devices 24*b* to 24*d*, the heat medium used in the heating operation is made to flow into the use side heat exchangers 26*b* to 26*d* with the amount that is sufficient enough to cover the air conditioning load required in the conditioned space such as the room 100*c*. The heat medium, after the heating operation, flows into the first heat exchanger related to heat medium 15*a* via the second heat medium flow switching devices 23*b* to 23*d* so as to be sucked into the first heat medium sending device 21*a* again.

With the function of the heat medium flow control device 24*a*, the heat medium used in the cooling operation is made to flow into the use side heat exchanger 26*a* with the amount sufficient enough to cover the air-conditioning load required in the conditioned space such as the room 100*c*. The heat medium, after the cooling operation, flows into the second heat exchanger related to heat medium 15*b* via the second heat medium flow switching device 23*a* so as to be sucked into the second heat medium sending device 21*b* again.

Cooling Only Operation Mode

Figure 5:
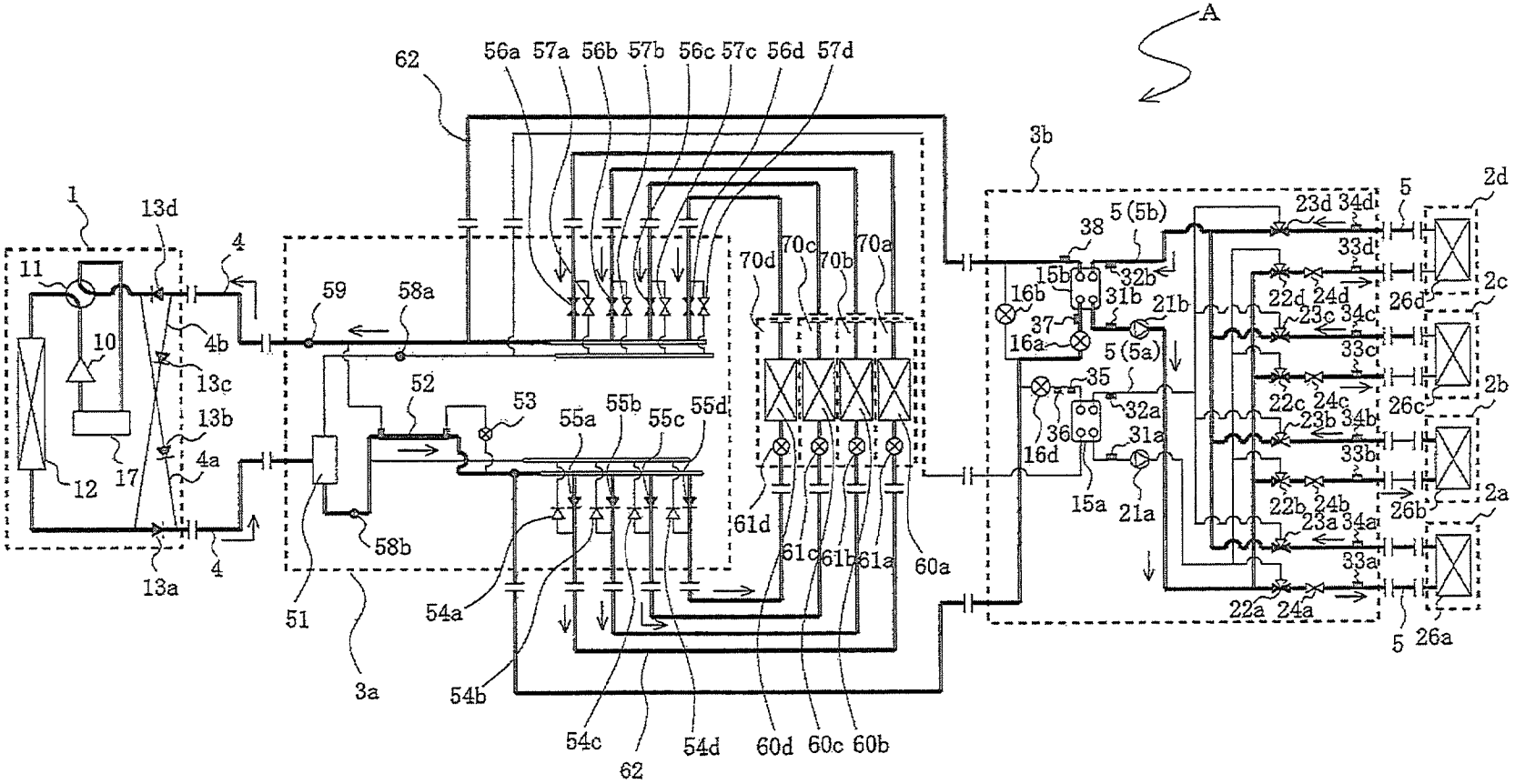
FIG. 5 is a refrigerant circuit diagram illustrating the flow of the refrigerants during a cooling only operation mode of the air-conditioning apparatus according to Embodiment 1 of the invention.

FIG. 5 is a refrigerant circuit diagram illustrating the flows of the refrigerants during the cooling only operation mode of the air-conditioning apparatus A. The cooling only operation mode in FIG. 5 is directed to an example where cooling load is generated in all of the use side heat exchangers 26*a* to 26*d* and the use side heat exchangers 60*a* to 60*d*. In FIG. 5, pipings denoted by thick lines are pipings through which the refrigerants (the heat source side refrigerant and the heat medium) flow. Furthermore, in FIG. 5, the flowing directions of the heat source side refrigerant and the heat medium are indicated by arrows.

In the cooling only operation mode shown in FIG. 5, the outdoor unit 1 switches the four-way valve 11 so as to cause the heat source side refrigerant discharged from the compressor 10 to flow into the heat source side heat exchanger 12. In the second heat medium relay unit 3*b*, the second heat medium sending device 21*b* is driven, the heat medium flow control devices 24 are opened, and the first heat medium flow switching devices 22 and the second heat medium flow switching devices 23 are controlled, so that the heat medium circulates between the second heat exchanger related to heat medium 15*b* and the use side heat exchangers 26*a* to 26*d*. In the first heat medium relay unit 3*a*, the expansion device 53 is closed, the on-off valves 56*a* to 56*d* are opened, and the on-off valves 57*a* to 57*d* are closed.

First, the flow of the heat source side refrigerant in the refrigerant circuit a will be described.

A low-temperature, low-pressure refrigerant is compressed by the compressor 10 and is discharged as a high-temperature, high-pressure gas refrigerant therefrom. The high-temperature, high-pressure gas refrigerant discharged from the compressor 10 passes through the four-way valve 11 so as to flow into the heat source side heat exchanger 12. Then, the high-temperature, high-pressure gas refrigerant is condensed in the heat source side heat exchanger 12 while transferring heat to outdoor air, thereby turning into a liquid refrigerant. The liquid refrigerant flowing out of the heat source side heat exchanger 12 passes through the check valve 13*a*, flows out of the outdoor unit 1, passes through the refrigerant piping 4, and flows into the first heat medium relay unit 3*a*. The liquid refrigerant flowing into the first heat medium relay unit 3*a* flows into the gas-liquid separator 51.

The liquid refrigerant flowing into the gas-liquid separator 51 travels through the high-pressure liquid piping 58*b*, and a portion thereof flows out from the first heat medium relay unit 3*a* so as to flow into the second heat medium relay unit 3*b*. The liquid piping flowing into the second heat medium relay unit 3*b* is throttled and expanded by the expansion device 16*a*, and flows into the second heat exchanger related to heat medium 15*b* as a low-temperature, low-pressure two-phase gas-liquid refrigerant. The two-phase gas-liquid refrigerant receives heat from the heat medium circulating through the heat medium circuit b at the second heat exchanger related to heat medium 15*b* functioning as an evaporator, so as to turn into a low-temperature, low-pressure gas refrigerant while cooling the heat medium.

The gas refrigerant flowing out from the second heat exchanger related to heat medium 15*b* flows out from the second heat medium relay unit 3*b* and travels through the low-pressure gas piping 59 and the refrigerant piping 4 via the first heat medium relay unit 3*a* so as to flow into the outdoor unit 1. The refrigerant flowing into the outdoor unit 1 passes through the check valve 13*d* so as to be sucked into the compressor 10 again via the four-way valve 11 and the accumulator 17.

The remaining liquid refrigerant traveling through the high-pressure liquid piping 58*b* from the gas-liquid separator 51 passes through the check valves 55*a* to 55*d* and is decompressed by the expansion devices 61*a* to 61*d* so as to turn into a low-pressure two-phase gas-liquid refrigerant. The low-pressure two-phase gas-liquid refrigerant flows into the use side heat exchangers 60*a* to 60*d* where the refrigerant absorbs heat (cools the surrounding air) and evaporates into a low-pressure gas refrigerant. After passing through the on-off valves 56*a* to 56*d*, the low-pressure gas refrigerant merges with the low-pressure gas refrigerant from the second heat medium relay unit 3*b* and flows into the outdoor unit 1 via the low-pressure gas piping 59 and the refrigerant piping 4.

With the function of the expansion devices 61*a* to 61*d*, the heat source side refrigerant used in the cooling operation is made to flow into the use side heat exchangers 60*a* to 60*d* with the amount sufficient enough to cover the air-conditioning load required in the conditioned space.

Next, the flow of the heat medium in the heat medium circuit b will be described.

The heat medium pressurized in and flowing out from the second heat medium sending device 21*b* travels through the heat medium flow control devices 24*a* to 24*d* via the first heat medium flow switching devices 22*a* to 22*d* so as to flow into the use side heat exchangers 26*a* to 26*d*. Then, the heat medium receives heat from indoor air at the use side heat exchangers 26*a* to 26*d* so as to cool the room 100*c* where the heat medium indoor units 2 are installed.

With the functions of the heat medium flow control devices 24*a* to 24*d*, the heat medium used in the cooling operation is made to flow into the use side heat exchangers 26*b* to 26*d* with the amount that is sufficient enough to cover the air conditioning load required in the conditioned space such as the room 100*c*. The heat medium, after the cooling operation, flows into the second heat exchanger related to heat medium 15*b* via the second heat medium flow switching devices 23*a* to 23*d* so as to be sucked into the second heat medium sending device 21*b* again.

Heating Only Operation Mode

Figure 6:
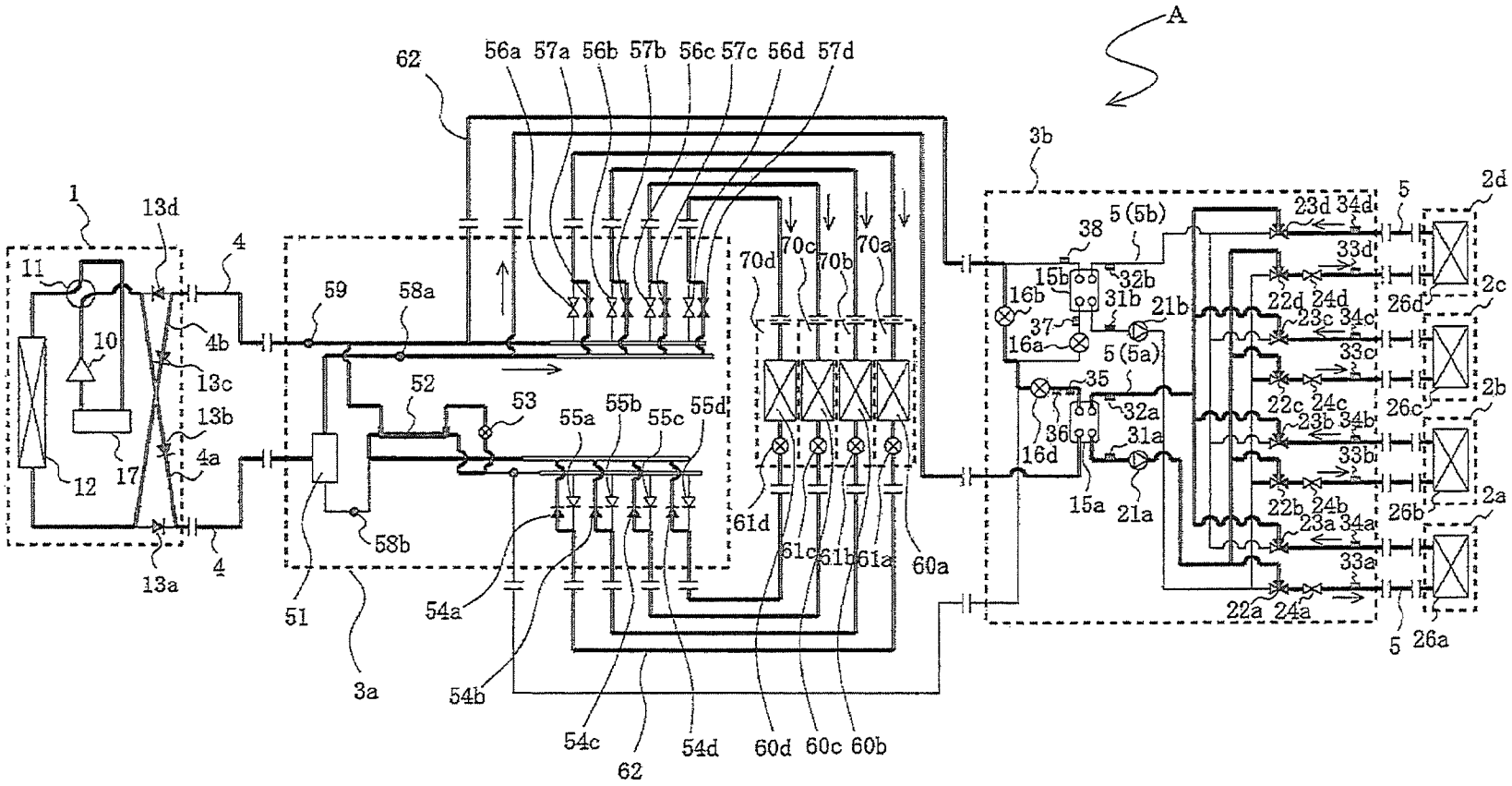
FIG. 6 is a refrigerant circuit diagram illustrating the flow of the refrigerants during a heating only operation mode of the air-conditioning apparatus according to Embodiment 1 of the invention.

FIG. 6 is a refrigerant circuit diagram illustrating the flow of the refrigerants during the heating only operation mode of the air-conditioning apparatus A. The heating only operation mode in FIG. 6 is directed to an example where heating load is generated in all of the use side heat exchangers 26*a* to 26*d* and the use side heat exchangers 60*a* to 60*d*. In FIG. 5, pipings denoted by thick lines are pipings through which the refrigerants (the heat source side refrigerant and the heat medium) flow. Furthermore, in FIG. 5, the flowing directions of the heat source side refrigerant and the heat medium are indicated by arrows.

In the heating only operation mode shown in FIG. 6, the outdoor unit 1 switches the four-way valve 11 so as to cause the heat source side refrigerant discharged from the compressor 10 to flow into the first heat medium relay unit 3*a* without passing through the heat source side heat exchanger 12. In the second heat medium relay unit 3*b*, the second heat medium sending device 21*a* is driven, the heat medium flow control devices 24 are opened, and the first heat medium flow switching devices 22 and the second heat medium flow switching devices 23 are controlled, so that the heat medium circulates between the second heat exchanger related to heat medium 15*a* and the use side heat exchangers 26*a* to 26*d*. In the first heat medium relay unit 3*a*, the opening degree of the expansion device 53 is adjusted, the on-off valves 56*a* to 56*d* are closed, and the on-off valves 57*a* to 57*d* are opened.

First, the flow of the heat source side refrigerant in the refrigerant circuit a will be described.

A low-temperature, low-pressure refrigerant is compressed by the compressor 10 and is discharged as a high-temperature, high-pressure gas refrigerant therefrom. The high-temperature, high-pressure gas refrigerant discharged from the compressor 10 passes through the four-way valve 11 so as to flow out from the outdoor unit 1 via the check valve 13*b*. The refrigerant flowing out from the outdoor unit 1 flows into the first heat medium relay unit 3*a* via the refrigerant piping 4. The refrigerant flowing into the first heat medium relay unit 3*a* flows into the gas-liquid separator 51. A portion of the gas refrigerant flowing out from the gas-liquid separator 51 travels through the high-pressure gas piping 58*a* so as to flow out from the first heat medium relay unit 3*a*.

The high-pressure gas refrigerant flowing out from the first heat medium relay unit 3*a* flows into the first heat exchanger related to heat medium 15*a* in the second heat medium relay unit 3*b*. The gas refrigerant flowing into the first heat exchanger related to heat medium 15*a* is condensed and liquefied therein while transferring heat to the heat medium circulating through the heat medium circuit b, thereby turning into a liquid refrigerant. The liquid refrigerant flowing out from the first heat exchanger related to heat medium 15*a* is decompressed by the expansion device 16*d* to a suction pressure of the compressor 10 so as to turn into a two-phase gas-liquid refrigerant. The two-phase gas-liquid refrigerant flows out from the second heat medium relay unit 3*b* and then flows into the first heat medium relay unit 3*a*.

The two-phase gas-liquid refrigerant flowing into the first heat medium relay unit 3*a* merges with the low-pressure two-phase gas-liquid refrigerant flowing from the expansion device 53 and the subcooling heat exchanger 52. The merged two-phase gas-liquid refrigerant flows into the outdoor unit 1 via the low-pressure gas piping 59 and the refrigerant piping 4. The two-phase gas-liquid refrigerant flowing into the outdoor unit 1 flows into the heat source side heat exchanger 12 via the check valve 13*c*. The two-phase gas-liquid refrigerant flowing into the heat source side heat exchanger 12 turns into a low-pressure gas refrigerant while cooling the surrounding air, and is sucked into the compressor 10 again via the four-way valve 11 and the accumulator 17.

The remaining gas refrigerant flowing out from the gas-liquid separator 51 flows into the use side heat exchangers 60*a* to 60*d* via the on-off valves 57*a* to 57*d*. The high-pressure gas refrigerant flowing into the use side heat exchangers 60*a* to 60*d* heats the surrounding air and turns into a high-pressure liquid refrigerant, which then flows out from the use side heat exchangers 60*a* to 60*d*. The high-pressure liquid refrigerant flowing out from the use side heat exchangers 60*a* to 60*d* travels through the expansion devices 61*a* to 61*d* and the check valves 54*a* to 54*d* so as to flow into the first heat medium relay unit 3*a*. The refrigerant flowing into the first heat medium relay unit 3*a* is decompressed by the expansion device 53 so as to turn into a low-pressure two-phase gas-liquid refrigerant. The low-pressure two-phase gas-liquid refrigerant merges with the low-pressure two-phase refrigerant from the second heat medium relay unit 3*b* and flows into the outdoor unit 1 via the low-pressure gas piping 59 and the refrigerant piping 4.

With the functions of the expansion devices 61*a* to 61*d*, the heat source side refrigerant used in the heating operation is made to flow into the use side heat exchangers 60*a* to 60*d* with the amount that is sufficient enough to cover the air conditioning load required in the conditioned space.

Next, the flow of the heat medium in the heat medium circuit b will be described.

The heat medium pressurized in and flowing out from the first heat medium sending device 21*a* travels through the heat medium flow control devices 24*a* to 24*d* via the first heat medium flow switching devices 22*a* to 22*d* so as to flow into the use side heat exchangers 26*a* to 26*d*. Then, the heat medium transfers heat to indoor air at the use side heat exchangers 26*a* to 26*d* so as to heat the room 100*c* where the heat medium indoor units 2 are installed.

With the functions of the heat medium flow control devices 24*a* to 24*d*, the heat medium used in the heating operation is made to flow into the use side heat exchangers 26*b* to 26*d* with the amount that is sufficient enough to cover the air conditioning load required in the conditioned space such as the room 100*c*. The heat medium, after the heating operation, flows into the first heat exchanger related to heat medium 15*a* via the second heat medium flow switching devices 23*a* to 23*d* so as to be sucked into the first heat medium sending device 21*a* again.

Since the air-conditioning apparatus A according to Embodiment 1 separates the heat medium relay unit into two units (the first heat medium relay unit 3*a* and the second heat medium relay unit 3*b*), a space where the cooling/heating operation is performed by directly using a refrigerant (referred to as "direct expansion method" hereinafter) and a space where the cooling/heating operation is performed with a heat medium by indirectly using a refrigerant (referred to as "indirect method" hereinafter) can be separated from each other. Specifically, in the air-conditioning apparatus A, the first heat medium relay unit 3*a* is provided with connection ports (the connection ports 74 and the connection ports 71) for connecting to the refrigerant indoor units 70 so as to allow the heat source side refrigerant to flow therethrough, and the second heat medium relay unit is provided with connection ports (the connection ports 72 and the connection ports 73) for connecting to the heat medium indoor units 2 so as to allow the heat medium to flow therethrough.

With this configuration, the direct expansion method and the indirect method can be used in a mixed fashion in the air-conditioning apparatus A. Therefore, the air-conditioning apparatus A uses the direct expansion method for performing cooling/heating operation in places that cannot be cooled by using water, such as a computer room and the server room 100*a*, and uses the indirect method for performing cooling/heating operation in places with many people, such as an office or the room 100*c*, thereby increasing safety and reliability of the system. Accordingly, the air-conditioning apparatus A can achieve a higher degree of freedom in terms of installation.

Furthermore, by providing the second heat medium relay unit 3*b* with at least two heat exchangers related to heat medium, a single air-conditioning apparatus A will be sufficient even in a space where the cooling operation and the heating operation are both performed in a mixed fashion.

Although Embodiment 1 is directed to a case where the gas-liquid separator 51, which separates the heat source side refrigerant supplied from the outdoor unit 1 into a gas refrigerant and a liquid refrigerant, is provided in the first heat medium relay unit 3*a*, the first heat medium relay unit 3*a* does not need to be provided with the gas-liquid separator 51 if carbon dioxide is used as the heat source side refrigerant. Specifically, if carbon dioxide is used as the heat source side refrigerant, a branch piping (refrigerant branching section) that branches the heat source side refrigerant to the high-pressure gas piping 58*a* and the high-pressure liquid piping 58*b* may be provided in place of the gas-liquid separator 51. This is because carbon dioxide enters a supercritical state when compressed to high pressure and is cooled in the supercritical state in a radiator (heat exchangers functioning as evaporators in the above description). Specifically, even after flowing out from a radiator, the carbon dioxide compressed to high pressure does not turn into a two-phase state being a mixture of a gas refrigerant and a liquid refrigerant. The operation of the air-conditioning apparatus A in each operation mode is the same as that described above even when carbon dioxide is used as the heat source side refrigerant and even when a branch piping is used in place of the gas-liquid separator 51, and advantages similar to those described above can be achieved in each of the operation modes.

Furthermore, although the on-off valves 56 and the on-off valves 57 are included in Embodiment 1, each set of on-off valves 56 and 57 may alternatively be constituted by a single three-way valve. Moreover, each set of check valves 54 and 55 may alternatively be constituted by a two-way valve.

Embodiment 2

Figure 8:
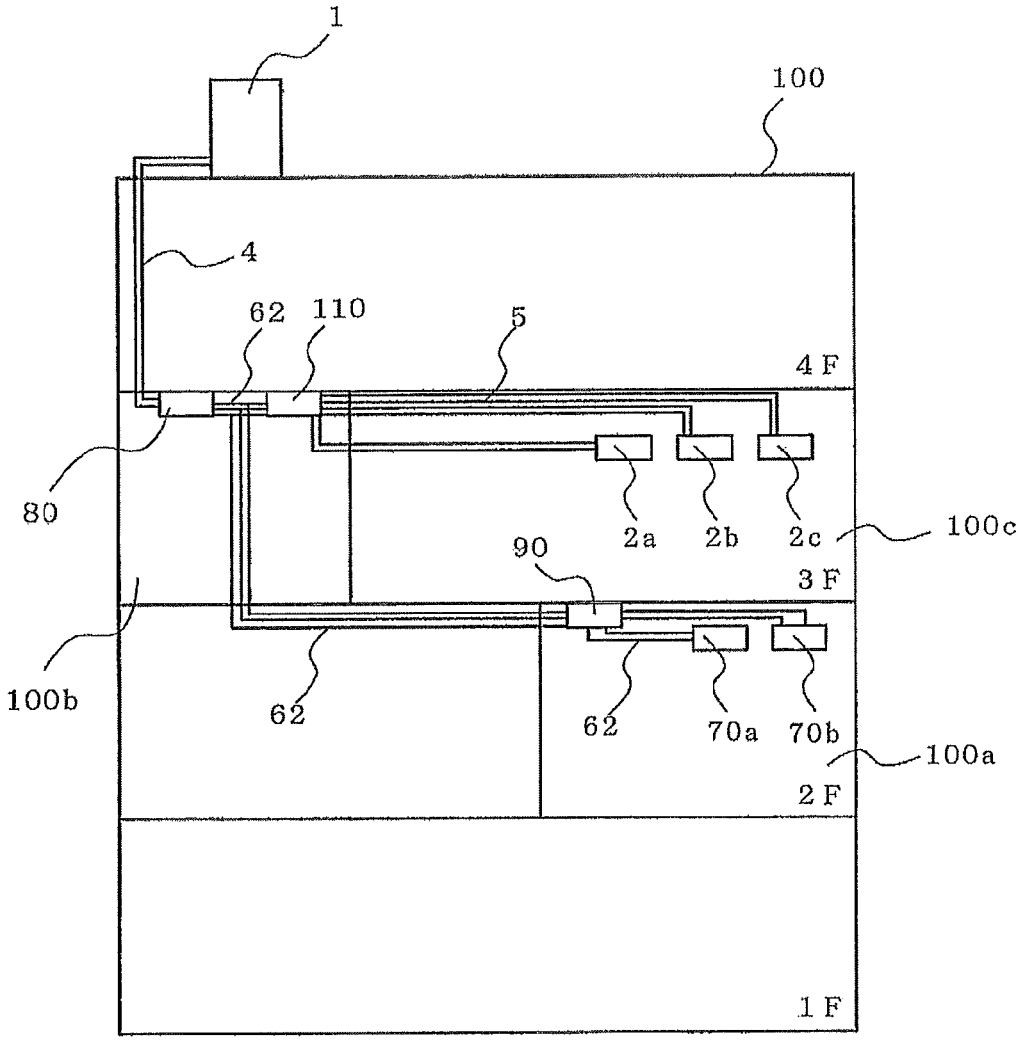

FIG. 8 schematically illustrates an installation example of an air-conditioning apparatus according to Embodiment 2 of the invention. The installation example of the air-conditioning apparatus will be described with reference to FIG. 8. The air-conditioning apparatus uses refrigeration cycles (a refrigerant circuit a and heat medium circuit b) through which refrigerants (a heat source side refrigerant and a heat medium) circulate, so that each indoor unit can freely select a cooling mode or a heating mode as an operation mode. The following description of Embodiment 2 will be focused on the differences from Embodiment 1. Components similar to those in Embodiment 1 are given the same reference numerals, and descriptions thereof will be omitted.

FIG. 8 shows a state where the air-conditioning apparatus according to Embodiment 2 is installed in a four-story building 100. The air-conditioning apparatus according to Embodiment 2 includes a single outdoor unit 1 as a heat source unit, multiple heat medium indoor units 2 (indoor units 2*a* to 2*c*), multiple refrigerant indoor units 70 (indoor units 70*a* and 70*b*), a first heat medium relay unit 80 and a third heat medium relay unit 90 interposed between the outdoor unit 1 and the refrigerant indoor units 70, and a second heat medium relay unit 110 interposed between the first heat medium relay unit 80 and the heat medium indoor units 2.

The outdoor unit 1 is installed on a rooftop of the building 100. The first heat medium relay unit 80 and the second heat medium relay unit 110 are installed in a shared zone 100*b* on the third floor. The heat medium indoor units 2 are installed in a room 100*c* on the third floor. The third heat medium relay unit 90 and the refrigerant indoor units 70 are installed in a server room 100*a* on the second floor.

Specifically, the air-conditioning apparatus according to Embodiment 2 includes a single outdoor unit 1, multiple heat medium indoor units 2, multiple refrigerant indoor units 70, and three heat medium relay units (the first heat medium relay unit 80, the second heat medium relay unit 110, and the third heat medium relay unit 90). The outdoor unit 1 and the first heat medium relay unit 80 are connected to each other via a refrigerant piping 4 that guides the heat source side refrigerant. The first heat medium relay unit 3*a*, the second heat medium relay unit 110, and the third heat medium relay unit 90 are connected to each other via refrigerant pipings 62 that guide the heat source side refrigerant. The second heat medium relay unit 110 and the heat medium indoor units 2 are connected to each other via heat medium pipings 5 that guide the heat medium. The third heat medium relay unit 90 and the refrigerant indoor units 70 are connected to each other via the refrigerant pipings 62 that guide the heat source side refrigerant. A circuit configuration of the air-conditioning apparatus according to Embodiment 2 will be described in detail later with reference to FIG. 9 and subsequent figures.

Although FIG. 8 shows the example in which the first heat medium relay unit 80 and the second heat medium relay unit 110 are installed in the shared zone 100*b*, not limited to the example, the first heat medium relay unit 80 and the second heat medium relay unit 110 may alternatively be installed in a space within the building 100 but separated from the room 100*c*, such as in a space above the ceiling. As a further alternative, the first heat medium relay unit 80 and the second heat medium relay unit 110 may be disposed in the vicinity of the outdoor unit 1. However, since the power required for conveying the heat medium would significantly increase if the distances from the first heat medium relay unit 80 to the refrigerant indoor units 70 and the heat medium indoor units 2 were to be increased, it should be noted that an energy saving effect would be reduced. Moreover, the number of heat medium relay units is not limited to that shown in FIG. 8, but may be set in accordance with the building in which the air-conditioning apparatus according to Embodiment 2 is installed.

Figure 9:
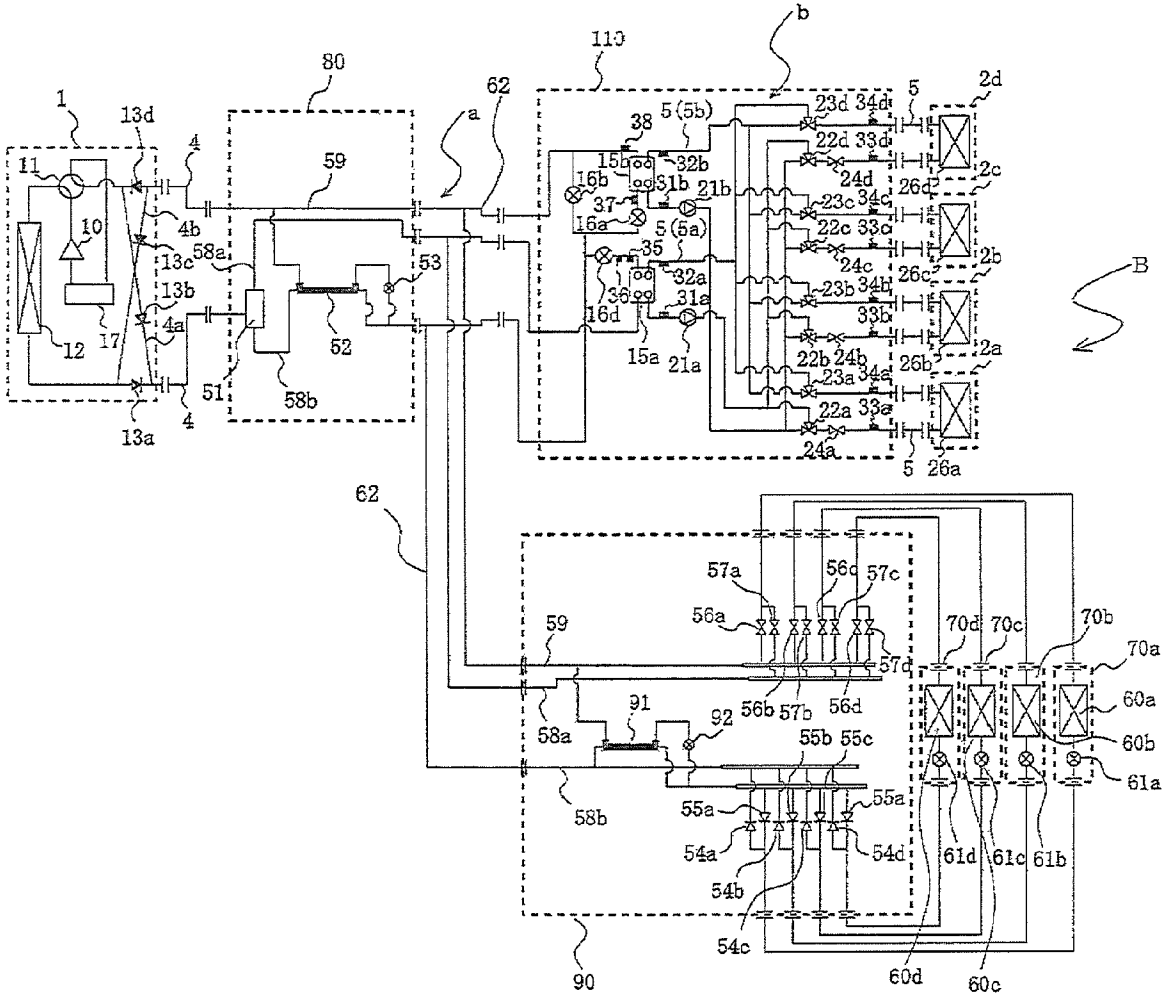
FIG. 9 is a schematic circuit configuration diagram showing an example of a circuit configuration of the air-conditioning apparatus according to Embodiment 2 of the invention.

FIG. 9 is a schematic circuit configuration diagram showing an example of a circuit configuration of the air-conditioning apparatus (referred to as "air-conditioning apparatus B" hereinafter) according to Embodiment 2. The circuit configuration of the air-conditioning apparatus B will be described in detail with reference to FIG. 9. As shown in FIG. 9, the outdoor unit 1 and the first heat medium relay unit 80 are connected to each other with the refrigerant piping 4; the first heat medium relay unit 80, the second heat medium relay unit 110, and the third heat medium relay unit 90 are connected to each other with the refrigerant pipings 62; the third heat medium relay unit 90 and the refrigerant indoor units 70 are connected to each other with the refrigerant pipings 62; and the second heat medium relay unit 110 and the heat medium indoor units 2 are connected to each other with the heat medium pipings 5 via a heat exchanger related to heat medium 15*a* and a heat exchanger related to heat medium 15*b* provided in the second heat medium relay unit 3*b*.

First Heat Medium Relay Unit 80

The first heat medium relay unit 80 is formed by taking out a portion of the first heat medium relay unit 3*a* described in Embodiment 1. Specifically, the first heat medium relay unit 80 is provided with the gas-liquid separator 51, the expansion device 53, and the subcooling heat exchanger 52. However, the low-pressure gas piping 59, the high-pressure gas piping 58*a*, and the high-pressure liquid piping 58*b* are provided with connection ports (not shown) so that the first heat medium relay unit 80 can be connected to the other heat medium relay units.

Second Heat Medium Relay Unit 110

The second heat medium relay unit 110 has a configuration similar to that of the second heat medium relay unit 3*b* described in Embodiment 1, but is given a reference numeral different therefrom for the sake of convenience.

Third Heat Medium Relay Unit 90

The third heat medium relay unit 90 is formed by taking out a portion of the first heat medium relay unit 3*a* described in Embodiment 1 and adding an expansion device 92 and a subcooling heat exchanger 91 thereto. The third heat medium relay unit 90 is connected by piping to the first heat medium relay unit 80 via the refrigerant pipings 62 (the low-pressure gas piping 59, the high-pressure gas piping 58*a*, and the high-pressure liquid piping 58*b*).

The subcooling heat exchanger 91 performs heat exchange between the high-pressure liquid refrigerant flowing through the high-pressure liquid piping 58*b* and the liquid refrigerant decompressed by the expansion device 92. Specifically, the refrigerant decompressed by the expansion device 92 is delivered to the subcooling heat exchanger 91 so as to ensure subcooling of the high-pressure liquid refrigerant from the first heat medium relay unit 80.

The various operation modes executed by the air-conditioning apparatus B will now be described. The air-conditioning apparatus B is capable of performing cooling operation or heating operation in each heat medium indoor unit 2 and each refrigerant indoor unit 70 on the basis of a command from the heat medium indoor unit 2 and a command from the refrigerant indoor unit 70. Specifically, the air-conditioning apparatus B can perform the same operation in all of the heat medium indoor units 2 and the refrigerant indoor units 70, or perform different operations among the heat medium indoor units 2 and the refrigerant indoor units 70.

The operation modes to be executed by the air-conditioning apparatus B include a cooling only operation mode in which the heat medium indoor units 2 and refrigerant indoor units 70 that are in operation all perform the cooling operation, a heating only operation mode in which the heat medium indoor units 2 and refrigerant indoor units 70 that are in operation all perform the heating operation, a cooling main operation mode in which the cooling load is greater, and a heating main operation mode in which the heating load is greater. Each operation mode will be described below along with the flow of the heat source side refrigerant and the heat medium.

Cooling Main Operation Mode

Figure 10:
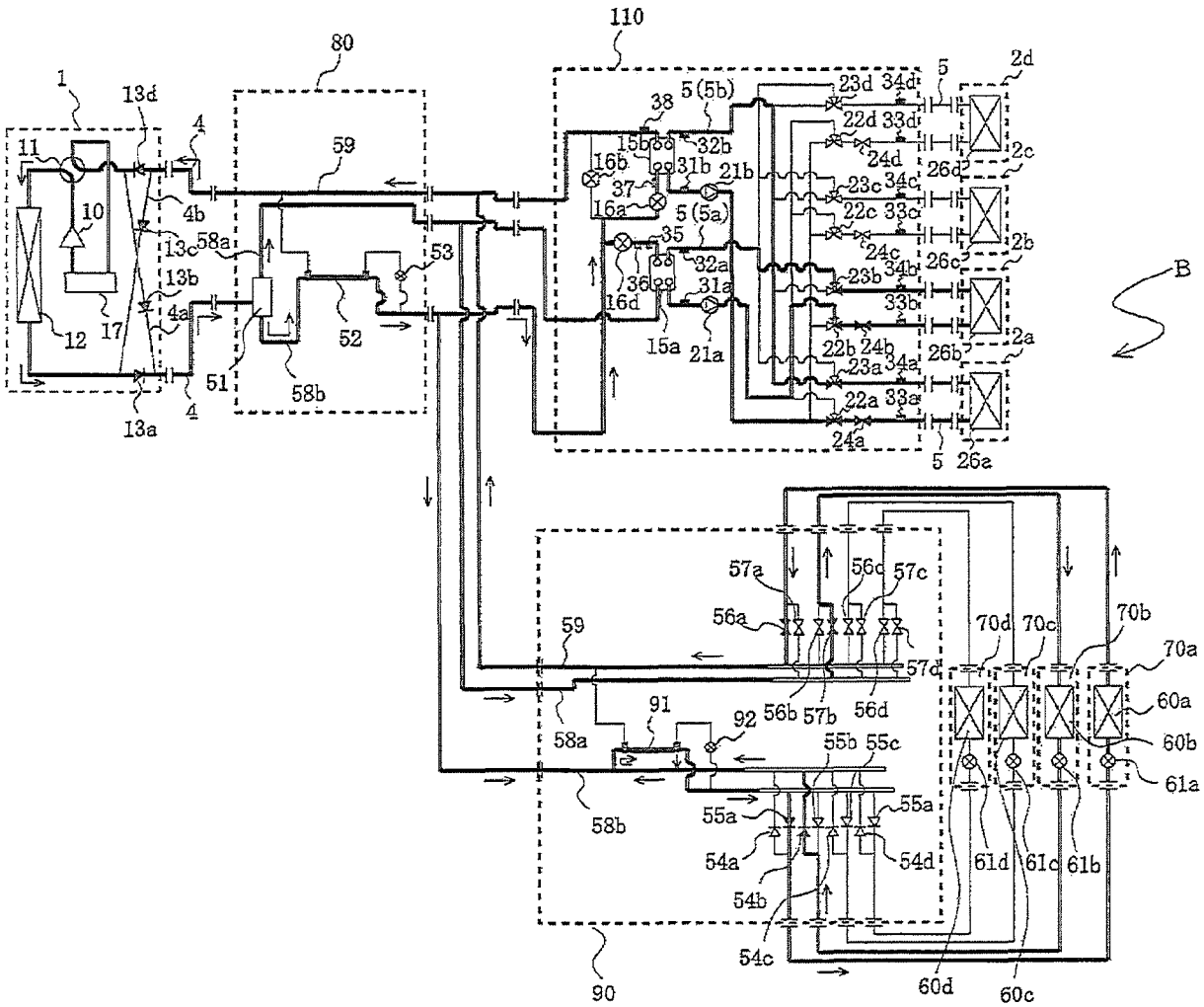
FIG. 10 is a refrigerant circuit diagram illustrating the flow of refrigerants during a cooling main operation mode of the air-conditioning apparatus according to Embodiment 2 of the invention.

FIG. 10 is a refrigerant circuit diagram illustrating the flow of the refrigerants during the cooling main operation mode of the air-conditioning apparatus B. The cooling main operation mode in FIG. 10 is directed to an example where cooling load is generated in the use side heat exchanger 26*a* and the use side heat exchanger 60*a*, and heating load is generated in the use side heat exchanger 26*b* and the use side heat exchanger 60*b*. In FIG. 10, pipings depicted by thick lines are pipings through which the refrigerants (the heat source side refrigerant and the heat medium) circulate. Furthermore, in FIG. 10, the flowing directions of the heat source side refrigerant and the heat medium are indicated by arrows.

In the cooling main operation mode shown in FIG. 10, in the outdoor unit 1, the four-way valve 11 is switched so that the heat source side refrigerant discharged from the compressor 10 flows into the heat source side heat exchanger 12. In the first heat medium relay unit 80, the expansion device 53 is closed. In the second heat medium relay unit 110, the first heat medium sending device 21*a* and the second heat medium sending device 21*b* are driven, the heat medium flow control devices 24 are opened, and the first heat medium flow switching devices 22 and the second heat medium flow switching devices 23 are controlled, so that the heat medium circulates between the first heat exchanger related to heat medium 15*a* and the use side heat exchanger 26*b*, as well as between the second heat exchanger related to heat medium 15*b* and the use side heat exchanger 26*a*. In the third heat medium relay unit 90, the expansion device 92 is closed, the on-off valve 56*a* is opened, the on-off valves 56*b* to 56*d* are closed, the on-off valve 57*b* is opened, and the on-off valves 57*a*, 57*c*, and 57*d* are closed.

First, the flow of the heat source side refrigerant in the refrigerant circuit a will be described.

A low-temperature, low-pressure refrigerant is compressed by the compressor 10 and is discharged as a high-temperature, high-pressure gas refrigerant therefrom. The high-temperature, high-pressure gas refrigerant discharged from the compressor 10 passes through the four-way valve 11 so as to flow into the heat source side heat exchanger 12. Then, the high-temperature, high-pressure gas refrigerant is condensed in the heat source side heat exchanger 12 while transferring heat to outdoor air, thereby turning into a two-phase gas-liquid refrigerant. The two-phase gas-liquid refrigerant flowing out from the heat source side heat exchanger 12 passes through the check valve 13*a* so as to flow out from the outdoor unit 1, and then travels through the refrigerant piping 4 so as to flow into the first heat medium relay unit 80. The two-phase gas-liquid refrigerant flowing into the first heat medium relay unit 80 flows into the gas-liquid separator 51 so as to be separated into a gas refrigerant and a liquid refrigerant.

A portion of the gas refrigerant separated by the gas-liquid separator 51 travels through the high-pressure gas piping 58*a* so as to flow into the first heat exchanger related to heat medium 15*a* in the second heat medium relay unit 110. The gas refrigerant flowing into the first heat exchanger related to heat medium 15*a* is condensed and liquefied therein while transferring heat to the heat medium circulating through the heat medium circuit b, thereby turning into a liquid refrigerant. The liquid refrigerant flowing out from the first heat exchanger related to heat medium 15*a* travels through the expansion device 16*d*. On the other hand, the liquid refrigerant separated by the gas-liquid separator 51 flows into the second heat medium relay unit 110 via the high-pressure liquid piping 58*b* and merges with the liquid refrigerant flowing from the first heat exchanger related to heat medium 15*a* and the expansion device 16*d*.

The merged liquid refrigerant is throttled and expanded by the expansion device 16*a*, and flows into the second heat exchanger related to heat medium 15*b* as a low-temperature, low-pressure two-phase gas-liquid refrigerant. The two-phase gas-liquid refrigerant receives heat from the heat medium circulating through the heat medium circuit b at the second heat exchanger related to heat medium 15*b* functioning as an evaporator, so as to turn into a low-temperature, low-pressure gas refrigerant while cooling the heat medium. The gas refrigerant flowing out from the second heat medium heat exchanger 15*b* flows out from the second heat medium relay unit 110 and travels through the low-pressure gas piping 59 and the refrigerant piping 4 via the first heat medium relay unit 80 so as to flow into the outdoor unit 1. The refrigerant flowing into the outdoor unit 1 passes through the check valve 13*d* so as to be sucked into the compressor 10 again via the four-way valve 11 and the accumulator 17.

The high-pressure liquid refrigerant separated by the gas-liquid separator 51 travels through the high-pressure liquid piping 58*b*, and a portion thereof flows into the second heat medium relay unit 110 while the remaining high-pressure liquid refrigerant passes through the check valve 55*a* in the third heat medium relay unit 90 and is decompressed by the expansion device 61*a* so as to turn into a low-pressure two-phase gas-liquid refrigerant. The low-pressure two-phase gas-liquid refrigerant flows into the use side heat exchanger 60*a* where the refrigerant absorbs heat (cools the surrounding air) and evaporates into a low-pressure gas refrigerant. After passing through the on-off valve 56*a*, the low-pressure gas refrigerant merges with the low-pressure gas refrigerant from the second heat medium relay unit 110 and flows into the outdoor unit 1 via the low-pressure gas piping 59 and the refrigerant piping 4.

On the other hand, the remaining high-pressure gas refrigerant separated by the gas-liquid separator 51 travels through the high-pressure gas piping 58*a* and the on-off valve 57*b* so as to flow into the use side heat exchanger 60*b* where the refrigerant transfers heat (heats the surrounding air) and condenses into a high-pressure liquid refrigerant. The high-pressure liquid refrigerant flows into the first heat medium relay unit 80 via the expansion device 61*b* and the check valve 54*b* and then flows into the third heat medium relay unit 90 so as to merge with the high-pressure liquid refrigerant separated by the gas-liquid separator 51.

With the functions of the expansion devices 61*a* and 61*b*, the heat source side refrigerant used in the cooling operation and heating operation is made to flow into the use side heat exchangers 60*a* and 60*b* with the amount that is sufficient enough to cover the air conditioning load required in the conditioned space.

Next, the flow of the heat medium in the heat medium circuit b will be described.

The heat medium pressurized in and flowing out from the first heat medium sending device 21*a* travels through the heat medium flow control device 24*b* via the first heat medium flow switching device 22*b* so as to flow into the use side heat exchanger 26*b*. Then, the heat medium transfers heat to indoor air at the use side heat exchanger 26*b* so as to heat the room 100*c* where the heat medium indoor units 2 are installed. On the other hand, the heat medium pressurized in and flowing out from the second heat medium sending device 21*b* travels through the heat medium flow control device 24*a* via the first heat medium flow switching device 22*a* so as to flow into the use side heat exchanger 26*a*. Then, the heat medium receives heat from indoor air at the use side heat exchanger 26*a* so as to cool the room 100*c* where the heat medium indoor units 2 are installed.

With the function of the heat medium flow control device 24*b*, the heat medium used in the heating operation is made to flow into the use side heat exchanger 26*b* with the amount sufficient enough to cover the air-conditioning load required in the conditioned space such as the room 100*c*. The heat medium, after the heating operation, flows into the first heat exchanger related to heat medium 15*a* via the second heat medium flow switching device 23*b* so as to be sucked into the first heat medium sending device 21*a* again.

With the function of the heat medium flow control device 24*a*, the heat medium used in the cooling operation is made to flow into the use side heat exchanger 26*a* with the amount sufficient enough to cover the air-conditioning load required in the conditioned space such as the room 100*c*. The heat medium, after the cooling operation, flows into the second heat exchanger related to heat medium 15*b* via the second heat medium flow switching device 23*a* so as to be sucked into the second heat medium sending device 21*b* again.

Heating Main Operation Mode

Figure 11:
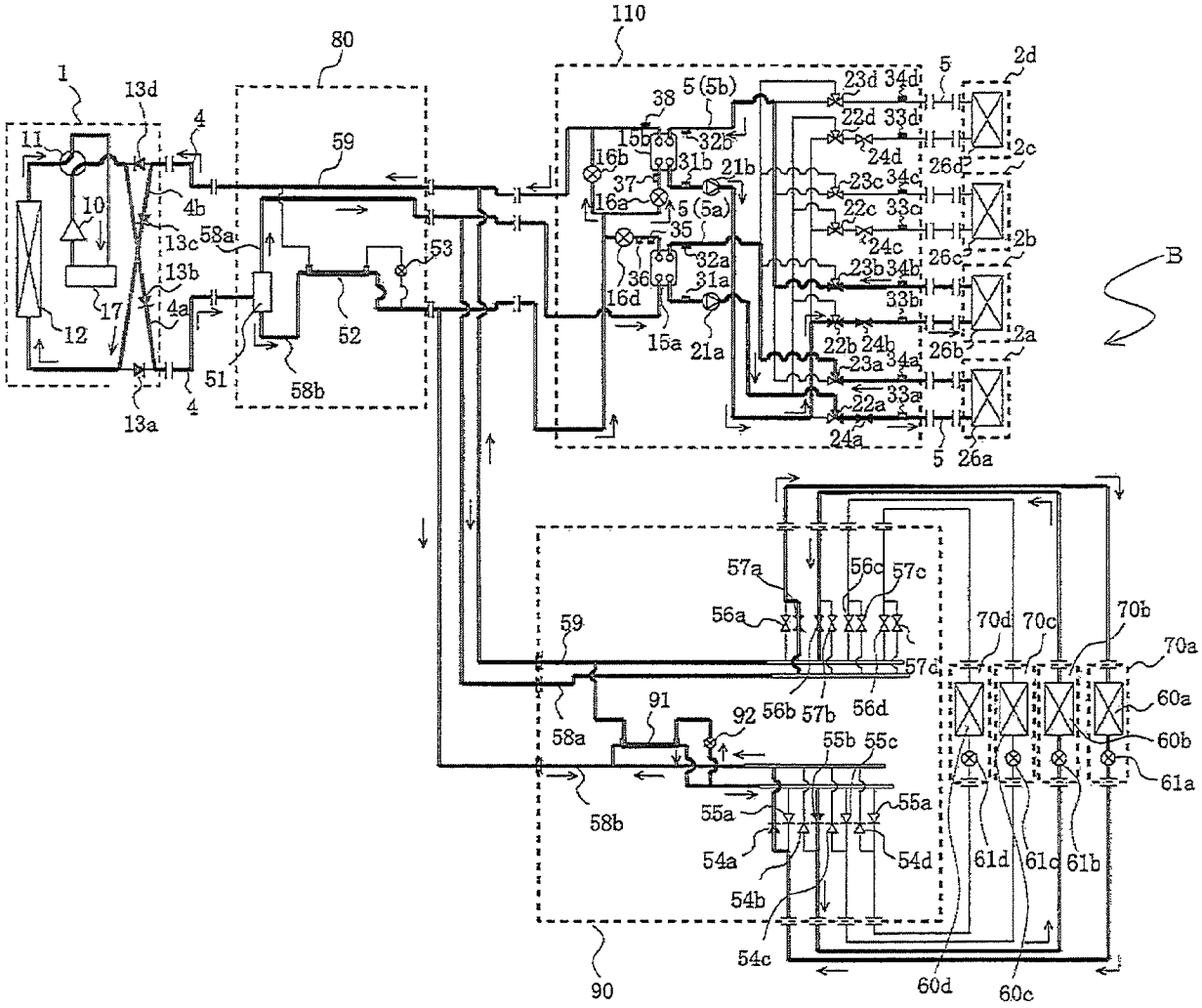
FIG. 11 is a refrigerant circuit diagram illustrating the flow of the refrigerants during a heating main operation mode of the air-conditioning apparatus according to Embodiment 2 of the invention.

FIG. 11 is a refrigerant circuit diagram illustrating the flow of the refrigerants during the heating main operation mode of the air-conditioning apparatus B. The heating main operation mode in FIG. 11 is directed to an example where cooling load is generated in the use side heat exchanger 26*b* and the use side heat exchanger 60*b*, and heating load is generated in the use side heat exchanger 26*a* and the use side heat exchanger 60*a*. In FIG. 11, pipings depicted by thick lines are pipings through which the refrigerants (the heat source side refrigerant and the heat medium) circulate. Furthermore, in FIG. 11, the flowing directions of the heat source side refrigerant and the heat medium are indicated by arrows.

In the heating main operation mode shown in FIG. 11, the outdoor unit 1 switches the four-way valve 11 so as to cause the heat source side refrigerant discharged from the compressor 10 to flow into the first heat medium relay unit 80 without passing through the heat source side heat exchanger 12. In the first heat medium relay unit 80, the expansion device 53 is closed. In the second heat medium relay unit 110, the first heat medium sending device 21*a* and the second heat medium sending device 21*b* are driven, the heat medium flow control devices 24 are opened, and the first heat medium flow switching devices 22 and the second heat medium flow switching devices 23 are controlled, so that the heat medium circulates between the first heat exchanger related to heat medium 15*a* and the use side heat exchanger 26*a*, as well as between the second heat exchanger related to heat medium 15*b* and the use side heat exchanger 26*b*. In the third heat medium relay unit 90, the opening degree of the expansion device 92 is adjusted, the on-off valve 56*b* is opened, the on-off valves 56*a*, 56*c*, and 56*d* are closed, the on-off valve 57*a* is opened, and the on-off valves 57*b* to 57*d* are closed.

First, the flow of the heat source side refrigerant in the refrigerant circuit a will be described.

A low-temperature, low-pressure refrigerant is compressed by the compressor 10 and is discharged as a high-temperature, high-pressure gas refrigerant therefrom. The high-temperature, high-pressure gas refrigerant discharged from the compressor 10 passes through the four-way valve 11 so as to flow out from the outdoor unit 1 via the check valve 13*b*. The refrigerant flowing out from the outdoor unit 1 flows into the first heat medium relay unit 80 via the refrigerant piping 4. In the refrigerant piping 4, a portion of the gas refrigerant is liquefied, and the refrigerant flowing into the first heat medium relay unit 80 flows into the gas-liquid separator 51 so as to be separated into a gas refrigerant and a liquid refrigerant. Then, the gas refrigerant and the liquid refrigerant travel through the high-pressure gas piping 58*a* and the high-pressure liquid piping 58*b*, respectively, so as to flow out from the first heat medium relay unit 80.

A portion of the high-pressure gas refrigerant flowing out from the first heat medium relay unit 80 flows into the first heat exchanger related to heat medium 15*a* in the second heat medium relay unit 110. The gas refrigerant flowing into the first heat exchanger related to heat medium 15*a* is condensed and liquefied therein while transferring heat to the heat medium circulating through the heat medium circuit b, thereby turning into a liquid refrigerant. The liquid refrigerant flowing out from the first heat exchanger related to heat medium 15*a* travels through the expansion device 16*d* where the liquid refrigerant is decompressed and expanded, thereby turning into a low-temperature, low-pressure two-phase gas-liquid refrigerant. On the other hand, a portion of the liquid refrigerant separated by the gas-liquid separator 51 flows into the second heat medium relay unit 110 via the high-pressure liquid piping 58*b* and merges with the two-phase gas-liquid refrigerant flowing from the first heat exchanger related to heat medium 15*a* and the expansion device 16*d*.

The merged two-phase gas-liquid refrigerant flows into the second heat exchanger related to heat medium 15*b*. This two-phase gas-liquid refrigerant receives heat from the heat medium circulating through the heat medium circuit b at the second heat exchanger related to heat medium 15*b* functioning as an evaporator, so as to flow out from the second heat exchanger related to heat medium 15*b* in a two-phase gas-liquid state while cooling the heat medium. The two-phase gas-liquid refrigerant flowing out from the second heat exchanger related to heat medium 15*b* flows out from the second heat medium relay unit 110 and then travels through the low-pressure gas piping 59 and the refrigerant piping 4 via the first heat medium relay unit 80 so as to flow into the outdoor unit 1. The refrigerant flowing into the outdoor unit 1 flows into the heat source side heat exchanger 12 via the check valve 13*c*. The two-phase gas-liquid refrigerant flowing into the heat source side heat exchanger 12 turns into a low-pressure gas refrigerant while cooling the surrounding air, and is sucked into the compressor 10 again via the four-way valve 11 and the accumulator 17.

The remaining high-pressure gas refrigerant separated by the gas-liquid separator 51 and flowing out from the first heat medium relay unit 80 flows into the third heat medium relay unit 90. The high-pressure gas refrigerant flowing into the third heat medium relay unit 90 passes through the on-off valve 57*a* so as to flow into the use side heat exchanger 60*a* where the refrigerant transfers heat (heats the surrounding air) and condenses into a high-pressure liquid refrigerant. The high-pressure liquid refrigerant travels through the expansion device 61*a* and the check valve 54*a*. Then, the liquid refrigerant travels through the subcooling heat exchanger 91, and a portion of the liquid refrigerant flows into the low-pressure gas piping 59 via the expansion device 92, whereas another portion of the liquid refrigerant flows into the use side heat exchanger 60*b* via the check valve 55*b*.

A portion of the liquid refrigerant condensed by the use side heat exchanger 60*a* is supplied to the expansion device 61*b*, whereas another portion thereof is supplied to the heat medium relay unit.

The portion of the high-pressure liquid refrigerant cooled by the subcooling heat exchanger 91 passes through the check valve 55*b* and is decompressed by the expansion device 61*b* into a low-pressure two-phase gas-liquid refrigerant. The two-phase gas-liquid refrigerant flows into the use side heat exchanger 60*b* where the refrigerant turns into a low-pressure gas refrigerant while cooling the air, and flows out from the use side heat exchanger 60*b*. The low-pressure gas refrigerant flowing out from the use side heat exchanger 60 passes through the on-off valve 56*b* and merges with the low-pressure liquid refrigerant flowing via the subcooling heat exchanger 91, and then flows out from the third heat medium relay unit 90. Then, the merged refrigerant further merges with the refrigerant flowing out from the second heat medium relay unit 110 before flowing into the outdoor unit 1 via the first heat medium relay unit 80.

The remaining portion of the high-pressure liquid refrigerant cooled by the subcooling heat exchanger 91 flows into the expansion device 92 where the high-pressure liquid refrigerant is decompressed. The refrigerant decompressed by the expansion device 92 cools the high-pressure liquid refrigerant flowing into the subcooling heat exchanger 91 via the high-pressure liquid piping 58*b*, so as to turn into a low-pressure liquid refrigerant. The low-pressure liquid refrigerant flowing out from the subcooling heat exchanger 91 flows out from the third heat medium relay unit 90 and merges with the low-pressure gas refrigerant flowing out from the use side heat exchanger 60.

With the functions of the expansion devices 61*a* and 61*b*, the heat source side refrigerant used in the cooling operation and heating operation is made to flow into the use side heat exchangers 60*a* and 60*b* with the amount that is sufficient enough to cover the air conditioning load required in the conditioned space. FIG. 11 illustrates a case where the opening degree of the expansion device 16*b* is adjusted so as to adjust the flow rate of the refrigerant flowing into the second heat exchanger related to heat medium 15*b*.

Next, the flow of the heat medium in the heat medium circuit b will be described.

The heat medium pressurized in and flowing out from the first heat medium sending device 21*a* travels through the heat medium flow control device 24*a* via the first heat medium flow switching device 22*a* so as to flow into the use side heat exchanger 26*a*. Then, the heat medium transfers heat to indoor air at the use side heat exchanger 26*a* so as to heat the room 100*c* where the heat medium indoor units 2 are installed. On the other hand, the heat medium pressurized in and flowing out from the first heat medium sending device 21*b* travels through the heat medium flow control device 24*b* via the first heat medium flow switching device 22*b* so as to flow into the use side heat exchanger 26*b*. Then, the heat medium receives heat from indoor air at the use side heat exchanger 26*b* so as to cool the room 100*c* where the heat medium indoor units 2 are installed.

With the function of the heat medium flow control device 24*a*, the heat medium used in the heating operation is made to flow into the use side heat exchanger 26*a* with the amount that is sufficient enough to cover the air conditioning load required in the conditioned space such as the room 100*c*. The heat medium, after the heating operation, flows into the first heat exchanger related to heat medium 15*a* via the second heat medium flow switching device 23*a* so as to be sucked into the first heat medium sending device 21*a* again.

With regard to the heat medium used in the cooling operation, the heat medium flow control device 24*b* only allows a certain amount of the heat medium required for providing enough air-conditioning load for the conditioned space, such as the room 100*c*, to flow into the use side heat exchanger 26*b*. With the function of the heat medium flow control device 24*b*, the heat medium used in the cooling operation is made to flow into the use side heat exchanger 26*b* with the amount that is sufficient enough to cover the air conditioning load required in the conditioned space such as the room 100*c*. The heat medium, after the cooling operation, flows into the second heat exchanger related to heat medium 15*b* via the second heat medium flow switching device 23*b* so as to be sucked into the second heat medium sending device 21*b* again.

Cooling Only Operation Mode

Figure 12:
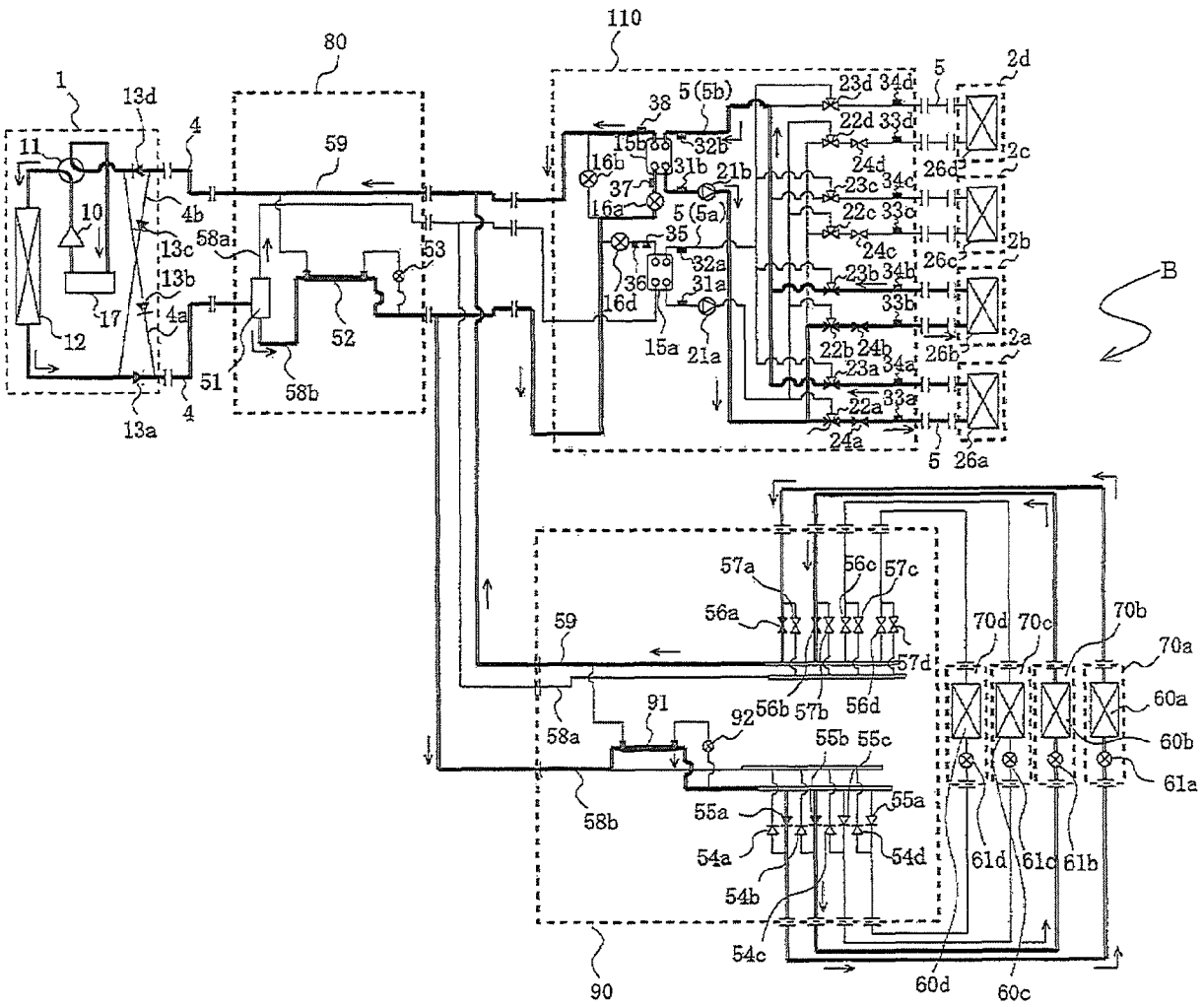
FIG. 12 is a refrigerant circuit diagram illustrating the flow of the refrigerants during a cooling only operation mode of the air-conditioning apparatus according to Embodiment 2 of the invention.

FIG. 12 is a refrigerant circuit diagram illustrating the flow of the refrigerants during the cooling only operation mode of the air-conditioning apparatus B. The cooling only operation mode in FIG. 12 is directed to an example where cooling load is generated in all of the use side heat exchangers 26*a* and 26*b* and the use side heat exchangers 60*a* and 60*b*. In FIG. 12, pipings denoted by thick lines are pipings through which the refrigerants (the heat source side refrigerant and the heat medium) flow. Furthermore, in FIG. 12, the flowing directions of the heat source side refrigerant and the heat medium are indicated by arrows.

In the cooling only operation mode shown in FIG. 12, the outdoor unit 1 switches the four-way valve 11 so as to cause the heat source side refrigerant discharged from the compressor 10 to flow into the heat source side heat exchanger 12. In the first heat medium relay unit 80, the expansion device 53 is closed. In the second heat medium relay unit 110, the second heat medium sending device 21*b* is driven, the heat medium flow control devices 24 are opened, and the first heat medium flow switching devices 22 and the second heat medium flow switching devices 23 are controlled, so that the heat medium circulates between the second heat exchanger related to heat medium 15*b* and the use side heat exchangers 26*a* and 26*b*. In the third heat medium relay unit 90, the expansion device 92 is closed, the on-off valves 56*a* and 56*b* are opened, the on-off valves 56*c* and 56*d* are closed, and the on-off valves 57*a* to 57*d* are closed.

First, the flow of the heat source side refrigerant in the refrigerant circuit a will be described.

A low-temperature, low-pressure refrigerant is compressed by the compressor 10 and is discharged as a high-temperature, high-pressure gas refrigerant therefrom. The high-temperature, high-pressure gas refrigerant discharged from the compressor 10 passes through the four-way valve 11 so as to flow into the heat source side heat exchanger 12. Then, the high-temperature, high-pressure gas refrigerant is condensed in the heat source side heat exchanger 12 while transferring heat to outdoor air, thereby turning into a liquid refrigerant. The liquid refrigerant flowing out from the heat source side heat exchanger 12 flows out from the outdoor unit 1 via the check valve 13*a* and flows into the first heat medium relay unit 80 via the refrigerant piping 4. The liquid refrigerant flowing into the first heat medium relay unit 80 flows into the gas-liquid separator 51.

The liquid refrigerant flowing into the gas-liquid separator 51 travels through the high-pressure liquid piping 58*b* so as to flow out from the first heat medium relay unit 80. A portion of the high-pressure liquid refrigerant flowing out from the first heat medium relay unit 80 flows into the second heat medium relay unit 110 and is throttled and expanded by the expansion device 16*a*, and flows into the second heat exchanger related to heat medium 15*b* as a low-temperature, low-pressure two-phase gas-liquid refrigerant. The two-phase gas-liquid refrigerant receives heat from the heat medium circulating through the heat medium circuit b at the second heat exchanger related to heat medium 15*b* functioning as an evaporator, so as to turn into a low-temperature, low-pressure gas refrigerant while cooling the heat medium.

The gas refrigerant flowing out from the second heat medium heat exchanger 15*b* flows out from the second heat medium relay unit 110 and travels through the low-pressure gas piping 59 and the refrigerant piping 4 via the first heat medium relay unit 80 so as to flow into the outdoor unit 1. The refrigerant flowing into the outdoor unit 1 passes through the check valve 13*d* so as to be sucked into the compressor 10 again via the four-way valve 11 and the accumulator 17.

The remaining high-pressure liquid refrigerant flowing out from the first heat medium relay unit 80 flows into the third heat medium relay unit 90. The high-pressure liquid refrigerant flowing into the third heat medium relay unit 90 passes through the check valves 55*a* and 55*b* and is decompressed by the expansion devices 61*a* and 61*b* so as to turn into a low-pressure two-phase gas-liquid refrigerant. The low-pressure two-phase gas-liquid refrigerant flows into the use side heat exchangers 60*a* and 60*b* where the refrigerant absorbs heat (cools the surrounding air) and evaporates into a low-pressure gas refrigerant. After passing through the on-off valves 56*a* and 56*b*, the low-pressure gas refrigerant merges with the low-pressure gas refrigerant from the second heat medium relay unit 110, flows into the first heat medium relay unit 80, and then flows into the outdoor unit 1 via the low-pressure gas piping 59 and the refrigerant piping 4.

With the functions of the expansion devices 61*a* and 61*b*, the heat source side refrigerant used in the cooling operation is made to flow into the use side heat exchangers 60*a* and 60*b* with the amount that is sufficient enough to cover the air conditioning load required in the conditioned space.

Next, the flow of the heat medium in the heat medium circuit b will be described.

The heat medium pressurized in and flowing out from the second heat medium sending device 21*b* travels through the heat medium flow control devices 24*a* and 24*b* via the first heat medium flow switching devices 22*a* and 22*b* so as to flow into the use side heat exchangers 26*a* and 26*b*. Then, the heat medium receives heat from indoor air at the use side heat exchangers 26*a* and 26*b* so as to cool the room 100*c* where the heat medium indoor units 2 are installed.

With the functions of the heat medium flow control devices 24*a* and 24*b*, the heat medium used in the cooling operation is made to flow into the use side heat exchangers 26*a* and 26*b* with the amount that is sufficient enough to cover the air conditioning load required in the conditioned space such as the room 100*c*. The heat medium, after the cooling operation, flows into the second heat exchanger related to heat medium 15*b* via the second heat medium flow switching devices 23*a* and 23*b* so as to be sucked into the second heat medium sending device 21*b* again.

Heating Only Operation Mode

Figure 13:
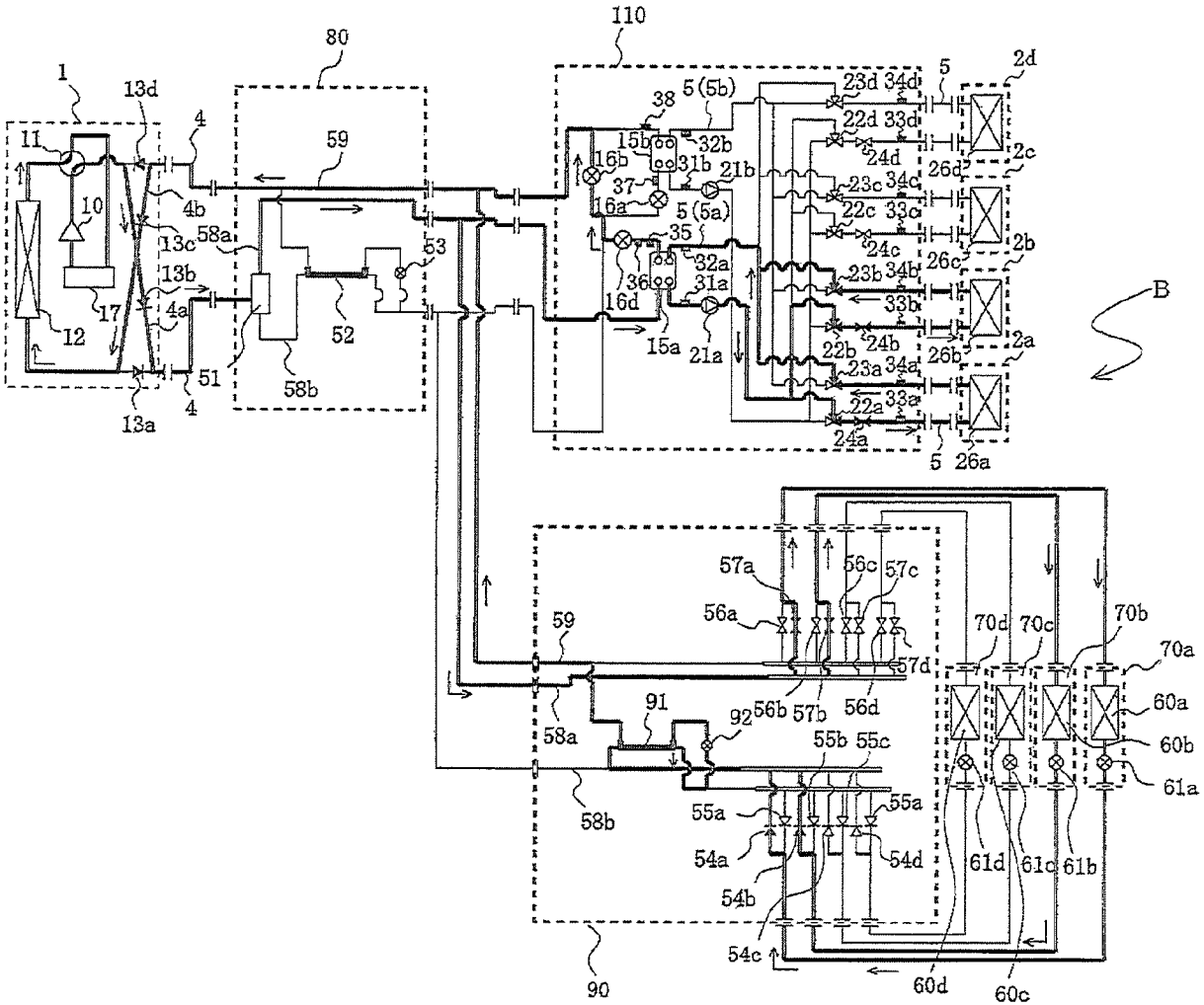
FIG. 13 is a refrigerant circuit diagram illustrating the flow of the refrigerants during a heating only operation mode of the air-conditioning apparatus according to Embodiment 2 of the invention.

FIG. 13 is a refrigerant circuit diagram illustrating the flow of the refrigerants during the heating only operation mode of the air-conditioning apparatus B. The heating only operation mode in FIG. 13 is directed to an example where heating load is generated in all of the use side heat exchangers 26*a* and 26*b* and the use side heat exchangers 60*a* and 60*b*. In FIG. 13, pipings denoted by thick lines are pipings through which the refrigerants (the heat source side refrigerant and the heat medium) flow. Furthermore, in FIG. 13, the flowing directions of the heat source side refrigerant and the heat medium are indicated by arrows.

In the heating only operation mode shown in FIG. 13, the outdoor unit 1 switches the four-way valve 11 so as to cause the heat source side refrigerant discharged from the compressor 10 to flow into the first heat medium relay unit 3*a* without passing through the heat source side heat exchanger 12. In the first heat medium relay unit 80, the expansion device 53 is closed. In the second heat medium relay unit 110, the first heat medium sending device 21*a* is driven, the heat medium flow control devices 24 are opened, and the first heat medium flow switching devices 22 and the second heat medium flow switching devices 23 are controlled, so that the heat medium circulates between the second heat exchanger related to heat medium 15*a* and the use side heat exchangers 26*a* and 26*b*. In the third heat medium relay unit 90, the opening degree of the expansion device 92 is adjusted, the on-off valves 56*a* to 56*d* are closed, the on-off valves 57*a* and 57*d* are opened, and the on-off valves 57*c* and 57*d* are closed.

First, the flow of the heat source side refrigerant in the refrigerant circuit a will be described.

A low-temperature, low-pressure refrigerant is compressed by the compressor 10 and is discharged as a high-temperature, high-pressure gas refrigerant therefrom. The high-temperature, high-pressure gas refrigerant discharged from the compressor 10 passes through the four-way valve 11 so as to flow out from the outdoor unit 1 via the check valve 13*b*. The refrigerant flowing out from the outdoor unit 1 flows into the first heat medium relay unit 80 via the refrigerant piping 4. The refrigerant flowing into the first heat medium relay unit 3*a* flows into the gas-liquid separator 51.

The gas refrigerant flowing into the gas-liquid separator 51 travels through the high-pressure gas piping 58*a* so as to flow out from the first heat medium relay unit 80. A portion of the high-pressure gas refrigerant flowing out from the first heat medium relay unit 80 flows into the first heat exchanger related to heat medium 15*a* in the second heat medium relay unit 110. The gas refrigerant flowing into the first heat exchanger related to heat medium 15*a* is condensed and liquefied therein while transferring heat to the heat medium circulating through the heat medium circuit b, thereby turning into a liquid refrigerant. The liquid refrigerant flowing out from the first heat exchanger related to heat medium 15*a* is decompressed by the expansion device 16*b* to a suction pressure of the compressor 10 so as to turn into a two-phase gas-liquid refrigerant. The two-phase gas-liquid refrigerant flows out from the second heat medium relay unit 110 and then flows into the first heat medium relay unit 80.

The remaining high-pressure gas refrigerant flowing out from the first heat medium relay unit 80 flows into the third heat medium relay unit 90. The high-pressure gas refrigerant flowing into the third heat medium relay unit 90 travels through the on-off valves 57*a* and 57*b* so as to flow into the use side heat exchangers 60*a* and 60*b*. The high-pressure gas refrigerant flowing into the use side heat exchangers 60*a* and 60*b* heats the surrounding air and turns into a high-pressure liquid refrigerant, which then flows out from the use side heat exchangers 60*a* and 60*b*. The high-pressure liquid refrigerant flowing out from the use side heat exchangers 60*a* and 60*b* travels through the expansion devices 61*a* and 61*b* and the check valves 54*a* and 54*b* and is further decompressed by the expansion device 92 so as to flow out from the third heat medium relay unit 90 as a low-pressure two-phase gas-liquid refrigerant. The refrigerant flowing out from the third heat medium relay unit 90 merges with the refrigerant from the second heat medium relay unit 110 and flows into the outdoor unit 1 via the low-pressure gas piping 59 and the refrigerant piping 4.

With the functions of the expansion devices 61*a* and 61*b*, the heat source side refrigerant used in the heating operation is made to flow into the use side heat exchangers 60*a* and 60*b* with the amount that is sufficient enough to cover the air conditioning load required in the conditioned space.

Next, the flow of the heat medium in the heat medium circuit b will be described.

The heat medium pressurized in and flowing out from the first heat medium sending device 21*a* travels through the heat medium flow control devices 24*a* and 24*b* via the first heat medium flow switching devices 22*a* and 22*b* so as to flow into the use side heat exchangers 26*a* and 26*b*. Then, the heat medium transfers heat to indoor air at the use side heat exchangers 26*a* and 26*b* so as to heat the room 100*c* where the heat medium indoor units 2 are installed.

With the functions of the heat medium flow control devices 24*a* and 24*b*, the heat medium used in the heating operation is made to flow into the use side heat exchangers 26*a* and 26*b* with the amount that is sufficient enough to cover the air conditioning load required in the conditioned space such as the room 100*c*. The heat medium, after the heating operation, flows into the first heat exchanger related to heat medium 15*a* via the second heat medium flow switching devices 23*a* and 23*b* so as to be sucked into the first heat medium sending device 21*a* again.

Since the air-conditioning apparatus B according to Embodiment 2 separates the heat medium relay unit into three units (the first heat medium relay unit 80, the second heat medium relay unit 110, and the third heat medium relay unit 90), a space where the cooling/heating operation is performed by the direct expansion method and a space where the cooling/heating operation is performed by the indirect method can be separated from each other. Specifically, in the air-conditioning apparatus B, the first heat medium relay unit 80 is provided with connection ports (which are the same as those in Embodiment 1) for connecting to the refrigerant indoor units 70 corresponding to the third heat medium relay unit 90 so as to allow the heat source side refrigerant to flow therethrough, and is also provided with connection ports (which are the same as those in Embodiment 1) for connecting to the heat medium indoor units 2 corresponding to the second heat medium relay unit 110 so as to allow the heat medium to flow therethrough.

With this configuration, the direct expansion method and the indirect method can be used in a mixed fashion in the air-conditioning apparatus B. Therefore, the air-conditioning apparatus B uses the direct expansion method for performing cooling/heating operation in places that cannot be cooled by using water, such as a computer room and the server room 100*a*, and uses the indirect method for performing cooling/heating operation in places with many people, such as an office or the room 100*c*, thereby increasing safety and reliability of the system. Accordingly, the air-conditioning apparatus B can achieve a higher degree of freedom in terms of installation.

Furthermore, by providing the second heat medium relay unit 3*b* with at least two heat exchangers related to heat medium, a single air-conditioning apparatus B will be sufficient even in a space where the cooling operation and the heating operation are both performed in a mixed fashion.

Although in Embodiment 1 and Embodiment 2, each of the heat medium flow control devices 24 disposed in the heat medium piping 5 on the heat medium inlet side of the corresponding heat medium indoor unit 2 is preferably a two-way valve that can close a passage, not limited to this, the flow rate may be controlled with a three-way valve used as a two-way valve by closing one of the ports, or a three way valve having a passage closing function bypassing the corresponding use side heat exchanger 26. Furthermore, each of the heat medium flow control devices 24 may be of a stepping-motor driven type that can control the flow rate in the passages. Moreover, the heat medium flow control devices 24 may each be of a type that opens and closes a two-way passage, such as an on-off valve, so as to control the average flow rate by repeating ON/OFF operations.

Although Embodiment 1 and Embodiment 2 are directed to an example where the accumulator 17 is included in the air-conditioning apparatus A, the accumulator 17 does not necessarily need to be provided. Furthermore, although air-sending devices are typically installed for the heat source side heat exchanger 12, the use side heat exchangers 26, and the use side heat exchangers 60 so as to facilitate the condensation or evaporation process by blowing air thereto, the invention is not limited to this configuration. For example, the use side heat exchangers 26 and the use side heat exchangers 60 may be panel heaters utilizing its radiation, and the heat source side heat exchanger 12 may be of a water-cooled type that transfers heat by using water or antifreeze. In other words, the heat source side heat exchanger 12, the use side heat exchangers 26, and the use side heat exchangers 60 may be of any type so long as they can transfer heat or receive heat.

Although Embodiment 1 and Embodiment 2 are directed to an example where two heat exchangers related to heat medium 15*a* and 15*b* are provided, the number thereof is not limited so long as the heat medium can be cooled and/or heated. Furthermore, each of the first heat medium sending device 21*a* and the second heat medium sending device 21*b* is not limited to one device; alternatively, multiple low-capacity heat medium sending devices may be parallel-connected to each other.

Although Embodiment 2 is directed to a case where the gas-liquid separator 51, which separates the heat source side refrigerant supplied from the outdoor unit 1 into a gas refrigerant and a liquid refrigerant, is provided in the first heat medium relay unit 80, the first heat medium relay unit 80 does not need to be provided with the gas-liquid separator 51 if carbon dioxide is used as the heat source side refrigerant. Specifically, if carbon dioxide is used as the heat source side refrigerant, a branch piping (refrigerant branching section) that branches the heat source side refrigerant to the high-pressure gas piping 58*a* and the high-pressure liquid piping 58*b* may be provided in place of the gas-liquid separator 51. This is because carbon dioxide enters a supercritical state when compressed to high pressure and is cooled in the supercritical state in a radiator (heat exchangers functioning as evaporators in the above description). Specifically, even after flowing out from a radiator, the carbon dioxide compressed to high pressure does not turn into a two-phase state being a mixture of a gas refrigerant and a liquid refrigerant. The operation of the air-conditioning apparatus A in each operation mode is the same as that described above even when carbon dioxide is used as the heat source side refrigerant and even when a branch piping is used in place of the gas-liquid separator 51, and advantages similar to those described above can be achieved in each of the operation modes.

REFERENCE SIGNS LIST

1. outdoor unit; 2. heat medium indoor units; 2*a*. indoor unit; 2*b*. indoor unit; 2*c*. indoor unit; 2*d*. indoor unit; 3. heat medium relay units; 3*a*. first heat medium relay unit; 3*b*. second heat medium relay unit; 4. refrigerant pipings; 4*a*. connection piping; 4*b*. connection piping; heat medium pipings; 5*a*. piping; 5*b*. piping; 10. compressor; 11. four-way valve; 12. heat source side heat exchanger; 13*a*. check valve; 13*b*. check valve; 13*c*. check valve; 13*d*. check valve; 15. heat exchangers related to heat medium; 15*a*. first heat exchanger related to heat medium; 15*b*. second heat exchanger related to heat medium; 16. expansion devices; 16*a*. expansion device; 16*b*. expansion device; 16*d*. expansion device; 17. accumulator; 21. heat medium sending devices; 21*a*. first heat medium sending device; 21*b*. second heat medium sending device; 22. first heat medium flow switching devices; 22*a*. first heat medium flow switching device; 22*b*. first heat medium flow switching device; 22*c*. first heat medium flow switching device; 22*d*. first heat medium flow switching device; 23. second heat medium flow switching devices; 23*a*. second heat medium flow switching device; 23*b*. second heat medium flow switching device; 23*c*. second heat medium flow switching device; 23*d*. second heat medium flow switching device; 24. heat medium flow control devices; 24*a*. heat medium flow control device; 24*b*. heat medium flow control device; 24*c*. heat medium flow control device; 24*d*. heat medium flow control device; 26. use side heat exchangers;

26*a*. use side heat exchanger; 26*b*. use side heat exchanger; 26*c*. use side heat exchanger; 26*d*. use side heat exchanger; 31. first heat medium temperature detecting means; 31*a*. first heat medium temperature detecting means; 31*b*. first heat medium temperature detecting means; 32. second heat medium temperature detecting means; 32*a*. second heat medium temperature detecting means; 32*b*. second heat medium temperature detecting means; 33. third heat medium temperature detecting means; 33*a*. third heat medium temperature detecting means; 33*b*. third heat medium temperature detecting means; 33*c*. third heat medium temperature detecting means; 33*d*. third heat medium temperature detecting means; 34. fourth heat medium temperature detecting means; 34*a*. fourth heat medium temperature detecting means; 34*b*. fourth heat medium temperature detecting means; 34*c*. fourth heat medium temperature detecting means; 34*d*. fourth heat medium temperature detecting means; 35. first refrigerant temperature detecting means; 36. refrigerant pressure detecting means; 37. second refrigerant temperature detecting means; 38. third refrigerant temperature detecting means; 51. gas-liquid separator; 52. subcooling heat exchanger; 53. expansion device; 54. check valves; 54*a*. check valve; 54*b*. check valve; 54*c*. check valve; 54*d*. check valve; 55. check valves; 55*a*. check valve; 55*b*. check valve; 55*c*. check valve; 55*d*. check valve; 56. on-off valves; 56*a*. on-off valve; 56*b*. on-off valve; 56*c*. on-off valve; 56*d*. on-off valve; 57. on-off valves; 57*a*. on-off valve; 57*b*. on-off valve; 57*c*. on-off valve; 57*d*. on-off valve; 58*a*. high-pressure gas piping; 58*b*. high-pressure liquid piping; 59. low-pressure gas piping; 60. use side heat exchangers; 60*a*. use side heat exchanger; 60*b*. use side heat exchanger; 60*c*. use side heat exchanger; 60*d*. use side heat exchanger; 61. expansion devices; 61*a*. expansion device; 61*b*. expansion device; 61*c*. expansion device; 61*d*. expansion device; 62. refrigerant pipings; 70. refrigerant indoor units; 70*a*. indoor unit; 70*b*. indoor unit; 70*c*. indoor unit; 70*d*. indoor unit; 71. connection ports; 71*a*. connection port; 71*b*. connection port; 71*c*. connection port; 71*d*. connection port; 72. connection ports; 72*a*. connection port; 72*b*. connection port; 72*c*. connection port; 72*d*. connection port; 73. connection ports; 73*a*. connection port; 73*b*. connection port; 73*c*. connection port; 73*d*. connection port; 74. connection ports; 74*a*. connection port; 74*b*. connection port; 74*c*. connection port; 74*d*. connection port; 80. first heat medium relay unit; 90. third heat medium relay unit; 91. subcooling heat exchanger; 92. expansion device; 100. building; 100*a*. server room; 100*b*. shared zone; 100*c*. room; 110. second heat medium relay unit; A. air-conditioning apparatus; B. air-conditioning apparatus; a. refrigerant circuit; b. heat medium circuits.

The invention claimed is:

1. An air-conditioning apparatus, comprising:

at least one outdoor unit equipped with a compressor and a heat source side heat exchanger, in which a heat source side refrigerant flows;

at least one refrigerant indoor unit equipped with an expansion device and a first use side heat exchanger, in which the heat source side refrigerant supplied from the at least one outdoor unit flows;

a plurality of heat medium indoor units each equipped with a second use side heat exchanger in which a heat medium different from the heat source side refrigerant flows;

a first heat medium relay unit interposed between the at least one outdoor unit and the at least one refrigerant indoor unit and between the at least one outdoor unit and the heat medium indoor units, having a piping in which the heat source side refrigerant flowing from the at least one outdoor unit passes and a piping in which the heat source side refrigerant returning back to the at least one outdoor unit passes; and at least one second heat medium relay unit interposed between the first heat medium relay unit and the heat medium indoor units, and including a plurality of heat exchangers related to heat medium that transfers heating energy or cooling energy, which is generated in the at least one outdoor unit and is stored in the heat source side refrigerant, to the heat medium, expansion devices for the heat source side refrigerant corresponding to the respective heat exchangers related to heat medium and flow switching devices respectively provided to the second use side heat exchangers, each of the flow switching devices switching a passage for the heat medium flowing to the corresponding second use side heat exchanger to a passage that is in communication with each of the heat exchangers related to heat medium, wherein one or some of the heat exchangers related to heat medium is made to function as a condenser and one or some of the remaining heat exchangers related to heat medium is made to function as an evaporator so that the second use side heat exchangers are capable of performing cooling operation and heating operation simultaneously.

2. The air-conditioning apparatus of claim 1, wherein the first heat medium relay unit includes a gas-liquid separator separating the heat source side refrigerant supplied from the at least one outdoor unit into a gas refrigerant and a liquid refrigerant, and the heat source side refrigerant supplied from the at least one outdoor unit to the first heat medium relay unit is separated into a gas refrigerant and a liquid refrigerant to be supplied to the at least one second heat medium relay unit and the third heat medium relay unit.

3. The air-conditioning apparatus of claim 1, further comprising at least one third heat medium relay unit interposed between the first heat medium relay unit and the at least one refrigerant indoor unit, equipped with at least a check valve and an on-off valve for switching the refrigerant passages through which the heat source side refrigerant flows, and supplying the heating energy or the cooling energy that is generated in the at least one outdoor heat exchanger to the first use side heat exchanger demanding the heating energy or the cooling energy.

4. The air-conditioning apparatus of claim 1, further comprising:

a plurality of refrigerant indoor units, wherein the first heat medium relay unit is equipped with an on-off valve and a check valve for switching the refrigerant passages corresponding to the respective refrigerant indoor units through which the heat source side refrigerant flows, and supplies the heating energy or the cooling energy that is generated in the at least one outdoor heat exchanger and is stored in the heat source side refrigerant to the first use side heat exchanger demanding the heating energy or the cooling energy.

5. The air-conditioning apparatus of claim 4, wherein the first heat medium relay unit includes connection ports connecting the on-off valve and the check valve to the refrigerant indoor units, and the at least one second heat medium relay unit includes connection ports connecting the two or more heat exchangers related to heat medium to the second use side heat exchangers.

6. The air-conditioning apparatus of claim 4, wherein the first heat medium relay unit includes a gas-liquid separator separating the heat source side refrigerant supplied from the at least one outdoor unit into a gas refrigerant and a liquid refrigerant, and the heat source side refrigerant supplied from the at least one outdoor unit to the first heat medium relay unit is separated into the gas refrigerant and the liquid refrigerant and is supplied to the at least one second heat medium relay unit.

7. The air-conditioning apparatus of claim 5, wherein the first heat medium relay unit includes a gas-liquid separator separating the heat source side refrigerant supplied from the at least one outdoor unit into a gas refrigerant and a liquid refrigerant, and the heat source side refrigerant supplied from the at least one outdoor unit to the first heat medium relay unit is separated into the gas refrigerant and the liquid refrigerant and is supplied to the at least one second heat medium relay unit.

* * * * *